US006629722B1

(12) United States Patent
Tang

(10) Patent No.: US 6,629,722 B1
(45) **Date of Patent: *Oct. 7, 2003**

(54) COLLAPSIBLE COOLER/UTILITY BAG AND CUP HOLDER FOR CASUAL SEATING

(76) Inventor: Larry Tang, 45 Park Knoll Dr., East Brunswick, NJ (US) 08816

( * ) Notice: Subject to any disclaimer, the term of this patent is extended or adjusted under 35 U.S.C. 154(b) by 371 days.

This patent is subject to a terminal disclaimer.

(21) Appl. No.: 09/644,507

(22) Filed: Aug. 24, 2000

(51) Int. Cl.[7] ..... A47C 7/62

(52) U.S. Cl. ..... 297/45; 297/42; 297/59; 297/188.08; 297/188.12; 297/188.13; 297/188.2

(58) Field of Search ..... 297/45, 42, 59, 297/188.08, 188.09, 188.12, 188.13, 188.2

(56) References Cited

U.S. PATENT DOCUMENTS 2,740,466 A * 4/1956 Priest ..... 297/188.2 X
5,490,712 A * 2/1996 Drelick ..... 297/188.12
5,573,288 A * 11/1996 Raffensperger ..... 297/188.12
5,722,717 A * 3/1998 Rettenberger ..... 297/188.13 X
5,988,465 A * 11/1999 Vitale et al. ..... 297/188.2 X
6,000,752 A * 12/1999 Shyr ..... 297/188.08
6,149,238 A * 11/2000 Tsai ..... 297/45 X
6,179,374 B1 * 1/2001 Tang ..... 297/45
6,209,951 B1 * 4/2001 Han ..... 297/45
6,231,119 B1 * 5/2001 Zheng ..... 297/45 X
6,322,138 B1 * 11/2001 Tang ..... 297/45
6,364,410 B1 * 4/2002 Tang ..... 297/45 X
6,375,258 B1 * 4/2002 Fang ..... 297/188.08
6,390,345 B1 * 5/2002 Brown et al. ..... 297/188.09 X
6,402,230 B1 * 6/2002 Tang ..... 297/45 X
6,402,231 B1 * 6/2002 Pedemonte ..... 297/188.13 X

FOREIGN PATENT DOCUMENTS

FR 777347 A * 2/1935 ..... 297/188.08

* cited by examiner

*Primary Examiner*—Rodney B. White
(74) *Attorney, Agent, or Firm*—Charles I. Brodsky

(57) ABSTRACT

In a reclining lounger, patio chair or cot which folds to a collapsed condition, a cooler/utility bag and cup holder is fastened to the fabric seat liner at a first location so as not to become lost in use, and is detachably secured at a second location to be released therefrom in folding the cooler/utility bag and cup holder into an empty slot provided in the lounger, patio chair or cot when being collapsed, in facilitating the transport of the cooler/utility bag and cup holder along with such casual seating when being stored.

9 Claims, 39 Drawing Sheets

171
171
B
163
A
A
B
162
160
163
30
33
50
28
143
144
33
117
35
126
24
18
45
142
16
26
141
35
126
113
25
115
111
37
25
10
104
37
20
60
91
95
102
103
91
95
25
25
14
93
101
40
55
103
22
12
101
102
77
40

490,492
470,472

A,B
470,472
490,492

470,472
490,492
416,424
450,456

A,B
470,472
490,492

632
D

630
B
C
632
D
630
B
A
628

A
628

624
C

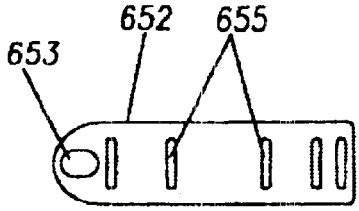
FIG.52
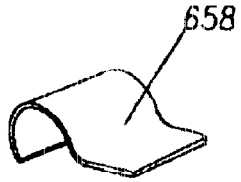
FIG.53
FIG.54
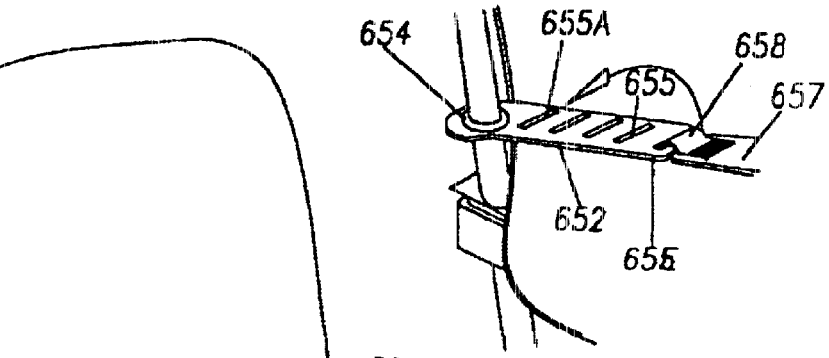
FIG.51
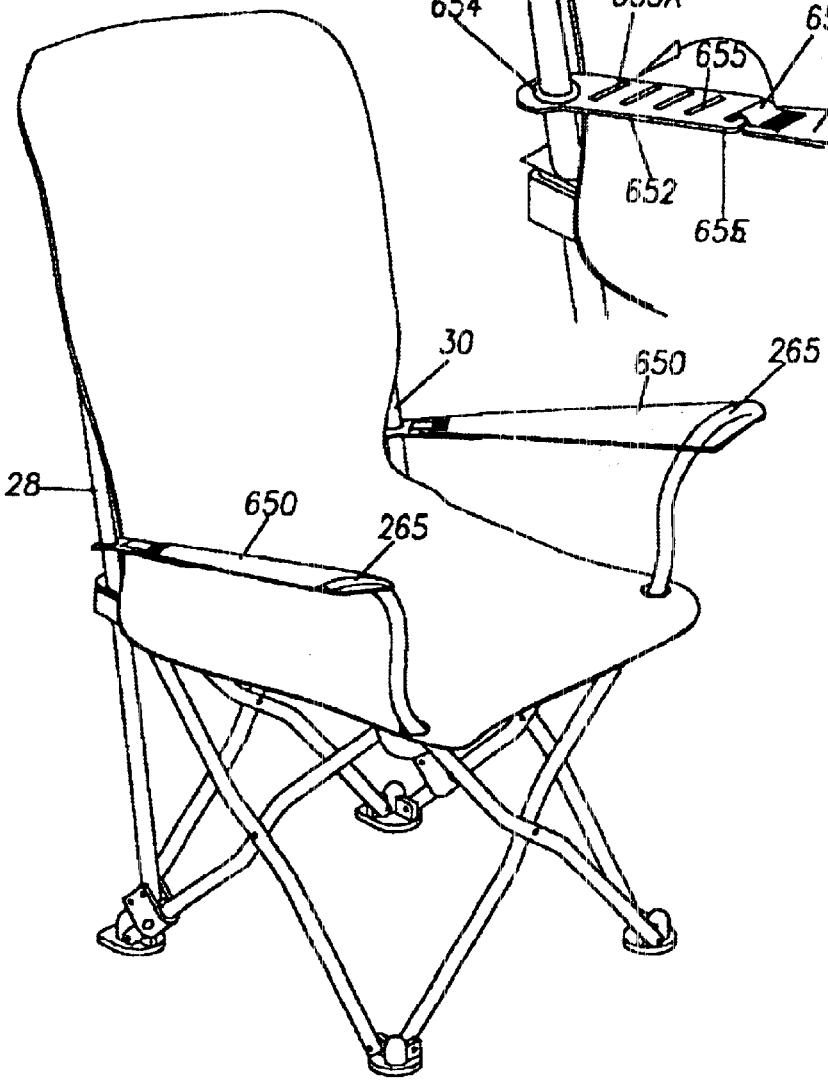
FIG.49

FIG.55
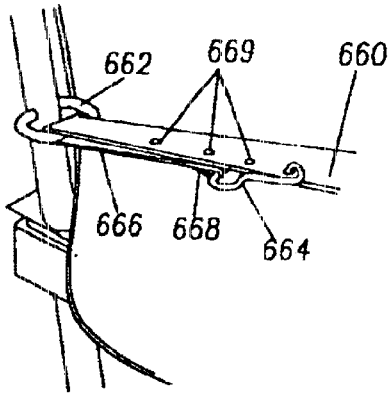
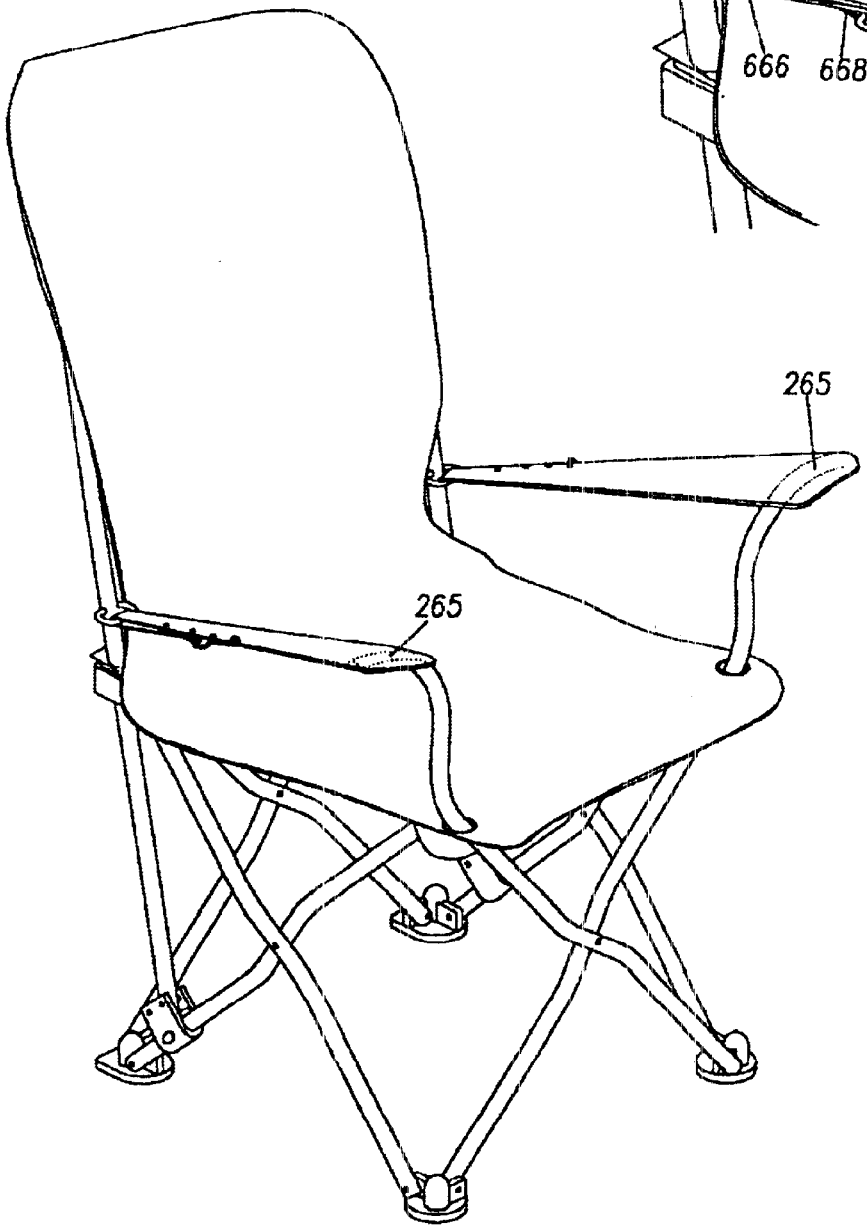
FIG.56

COLLAPSIBLE COOLER/UTILITY BAG AND CUP HOLDER FOR CASUAL SEATING

BACKGROUND OF THE INVENTION

1. Field of the Invention

This invention relates to casual seating, in general, and to collapsible reclining loungers, patio chairs and cots, in particular.

2. Description of the Related Art

Folding or collapsible chairs in the nature of furniture have been described in such U.S. Pat. No. as 3,635,520 (Roher et al) and U.S. Pat. No. 5,984,406 (Lee). In a multiple seat arrangement, they are also described in U.S. Pat. No. 5,570,928 (Staunton et al). For outdoor use, in camping and watching sports games, chairs of this type have been illustrated in U.S. Pat. No. 5,893,605 (Chang). When a reclining chair is desired for camping, hiking, fishing, and concert events, a construction of the type shown in U.S. Pat. No. 5,882,068 (Levine) is said to be useful.

While chairs of these types may prove adequate to suit their intended purposes, they have proven deficient when employed at beaches or seashore locations where users prefer low seat heights, typically no more than 6" to 10" above ground. While adjustments for multiple reclining positions in these chairs are highly desirable, the need for adjusting the position safely and easily is equally as important. As the reclining chair is oftentimes left unoccupied when open, it is almost as important, if not more so, for the beach chair to have a degree of stability about it, so as to limit its propensity to be blown about by wind gusts, as well as when being sat upon by a user. These various features, however, are not readily available with the type of folding lounge chair arrangements that typify the prior art—whether the folding lounger is used at the beach, at the seashore, or just in one's backyard.

At the same time, where simply used as a non-reclining patio chair, the acceptability of a folding chair depends in large part upon its strength and reliability of operation. In these two areas, the folding chair of the Lee Patent (U.S. Pat. No. 5,984,406) falls somewhat short.

To address these limitations, therefore, I have invented a new and improved recliner lounge and a new and improved patio chair. The lounge chair, described in an Application filed Apr. 18, 2000, entitled "Collapsible Reclining Beach Chair" (Ser. No. 09/551,664), now U.S. Pat. No. 6,179,374, incorporates a frame having pairs of crossed front, rear and side legs, with each leg including a pair of bends in opposing directions to allow bringing the seat level of the chair closer to the ground, and with connectors for the legs and a tilt-locking mechanism for stabilizing the chair and positively fixing it at the reclining angle set when opened or folded—and for collapsing the chair to a coinpact package when closed.

My second improvement, on the other hand, described in application Ser. No. 09/561,339, filed Apr. 28, 2000, and entitled "Collapsible Patio Chair" (now, U.S. Pat. No. 6,322,138), describes a patio chair incorporating a frame having left and right hand rests and pairs of crossed front, rear and side legs, and with connectors for stabilizing the chair when opened and for collapsing the chair to a compact package when closed. With front pad and rear pad connectors, and with rear connectors all being configured with generally perpendicular walls to apertures of which upper and lower ends of both rear legs and one side leg are pivotally connected, the hand rests are automatically folded as the chair is being collapsed, when front connectors employed include a notch within which the upper end of both front crossed legs are arranged to glide in forming the support for the hand rests, and to which an upper end of the other side leg is also pivotally connected.

I have also gone further in this area of casual seating to invent a new and improved collapsible cot, which can easily be carried about, and which is far lighter in weight than conventional cots and hammocks employed at a backyard setting, whose bulky frame typically stays outdoors the whole season, exposed to the elements. Such cot, also automatically folded as the cot is being collapsed, is described in my application Ser. No. 09/593,938, filed Jun. 15, 2000, entitled "Collapsible Cot" (now U.S. Pat. No. 6,364,410).

As will become clear from the following description, the present invention relates to these areas of casual seating, but more particularly, relates to pillows, cooler/utility bags and cup holders employable with any and all of these reclining loungers, patio chairs and cots of my improved designs—with the pillows, cooler/utility bags and cup holders being characterized by themselves being collapsible, so as to be folded when either the lounger, the patio chair, or the cot with which they are used is being collapsed to their individual compact package. As will also be seen, other aspects relate to arm rests and foot rests available with individual ones of these casual seating arrangements.

SUMMARY OF THE INVENTION

As will become clear from the following description, the reclining beach chair or lounger of application Ser. No. 09/551,664, U.S. Pat. No. 6,179,374 with which the collapsible pillow, cooler/utility bag and cup holder of the present invention is particularly useful, replaces the straight leg "X" tubing which characterizes standard designs by an "X" shape tubing incorporating pairs of bends to allow for bringing the seat level of the chair closer to the ground. By replacing the oftentimes used "brake lock" (for free-hand adjustment in sliding the chair back to the desired incline position) with a "positive" slide lock in which a "snap" is secured within a capturing aperture, a true, predetermined locking position results once the recline is set. As will be further described, to increase stability, the reclining lounger is constructed to effectively push forward its center of gravity, as by making the rear legs of the chair longer than the front legs. Where desired, a bar can also be fixed between opposing left and right sides of the chair frame back to further stabilize the chair when extended to an open position. In accordance with its invention, both the chair and the stabilizer bar are easily collapsible into a compact package to facilitate the carrying about and storage of this recliner.

The collapsible patio chair of application Ser. No. 09/561,339, U.S. Pat. No. 6,322,138, on the other hand, consists of a frame including pairs of front crossed legs and rear crossed legs, and two pairs of side crossed legs, with each pair of crossed legs being pivotally connected together where they cross; first and second front pad connectors pivotally connected to lower ends of one of the front crossed legs and one of the side crossed legs, respectively; first and second rear pad connectors pivotally connected to lower ends of one of the rear crossed legs and the other of the side crossed legs, respectively; first and second front connectors pivotally connected to upper ends of the one front crossed leg and the other of the side crossed legs, respectively; first and second rear connectors pivotally connected to upper ends of the rear crossed legs and the one side crossed leg, respectively; a pair of side supports passing through apertures in each of the first and second rear connectors having lower ends fixedly connected to the rear pad connectors; and a fabric liner connected to the first and second front connectors and to upper ends of the pair of side supports.

In accordance with this patio chair invention, to provide strength and reliability of operation beyond that characterizing the patented Lee design, the front connectors include a top surface having a notch therein open at one end and slightly larger than the diameter of the front crossed legs when composed as a tubular configuration, a first wall at an underside thereof defining one side of the notch and to which the upper ends of the front crossed legs are pivotally connected and a second wall at the underside, generally perpendicular to the first wall and combined therewith, to which the upper ends of the other of the side crossed legs are also pivotally connected. In like manner, each of the front and rear connector pads (as well as the rear connectors) include the two generally perpendicular walls for fastening with their respective pivotally connected legs -while the rear connector pads include apertures at the join of the two walls where the side supports are fixed.

The collapsible cot of application Ser. No. 09/593,938, U.S. Pat. No. 6,364,410, furthermore, consists of a frame including two pairs of front crossed legs, two pairs of rear crossed legs, and three pairs of side crossed legs, with each pair of crossed legs being pivotally connected together where they cross. First, second and third front pad connectors are included to pivotally connect to lower ends of the front crossed legs and to individual ones of the side crossed legs—while first, second and third rear pad connectors pivotally connect to lower ends of the rear crossed legs and to individual ones of others of the side crossed legs. First, second and third front connectors pivotally connect to upper ends of the front crossed legs and to individual ones of the side crossed legs, while first, second and third rear connectors pivotally connect to upper ends of the rear crossed legs and to individual ones of others of the side crossed legs. A fabric liner is included connected to two of the front connectors and to two of the rear connectors—and, in completing a preferred construction, a pair of side extenders are pivotally coupled to one of the front crossed legs and to one of the rear crossed legs, where they are joined with the fabric liner for a user to rest upon.

In accordance with this collapsible cot invention, to provide strength and reliability of operation, the front connectors where the two side extenders couple include a top surface having a notch therein open at one end and slightly larger than the diameter of the crossed legs when composed as a tubular configuration, a first wall at an underside thereof defining one side of the notch and to which the upper ends of the crossed legs are connected, along with a second wall at the underside, generally perpendicular to the first wall and combined therewith, to which the upper ends of the others of the crossed legs are also pivotally connected. In like manner, each of the remaining pad connectors include the two generally perpendicular walls for fastening with their respective pivotally connected legs.

In one embodiment of the collapsible cot invention, the side extenders are each pivotally coupled to their associated front crossed leg and to their rear crossed leg at a point below the connector which joins them, whereas in a second embodiment, the sides extenders are pivotally coupled at a point above the connectors. In this first embodiment, various taps, fasteners, and overlying rings are employed to align the crossed legs and extenders together, and to secure them in position; in the second embodiment, hinges are employed to achieve this comparable result.

As will become clear from the following description, the pillow, cooler/utility-bag and cupholder of the present invention cooperates with each of these recliner loungers, patio chairs and cots so as to be usable and collapsible, and to fold with each of them as they are each being collapsed to their respective compact package. When enlarged with the arm rest and/or foot rest for the recliner lounger, a particularly attractive type of casual seating can be had.

BRIEF DESCRIPTION OF THE DRAWINGS

These and other features of the collapsible constructions of the present invention will be more clearly understood from a consideration of the following description, taken in connection with the accompanying drawings, in which.

A. Ser. No. 09/551,664, U.S. Pat. No. 6,179,374, Collapsible Reclining Beach Chair

B. Ser. No. 09/561,339, U.S. Pat. No. 6,322,138, Collapsible Patio Chair

Figure 18:
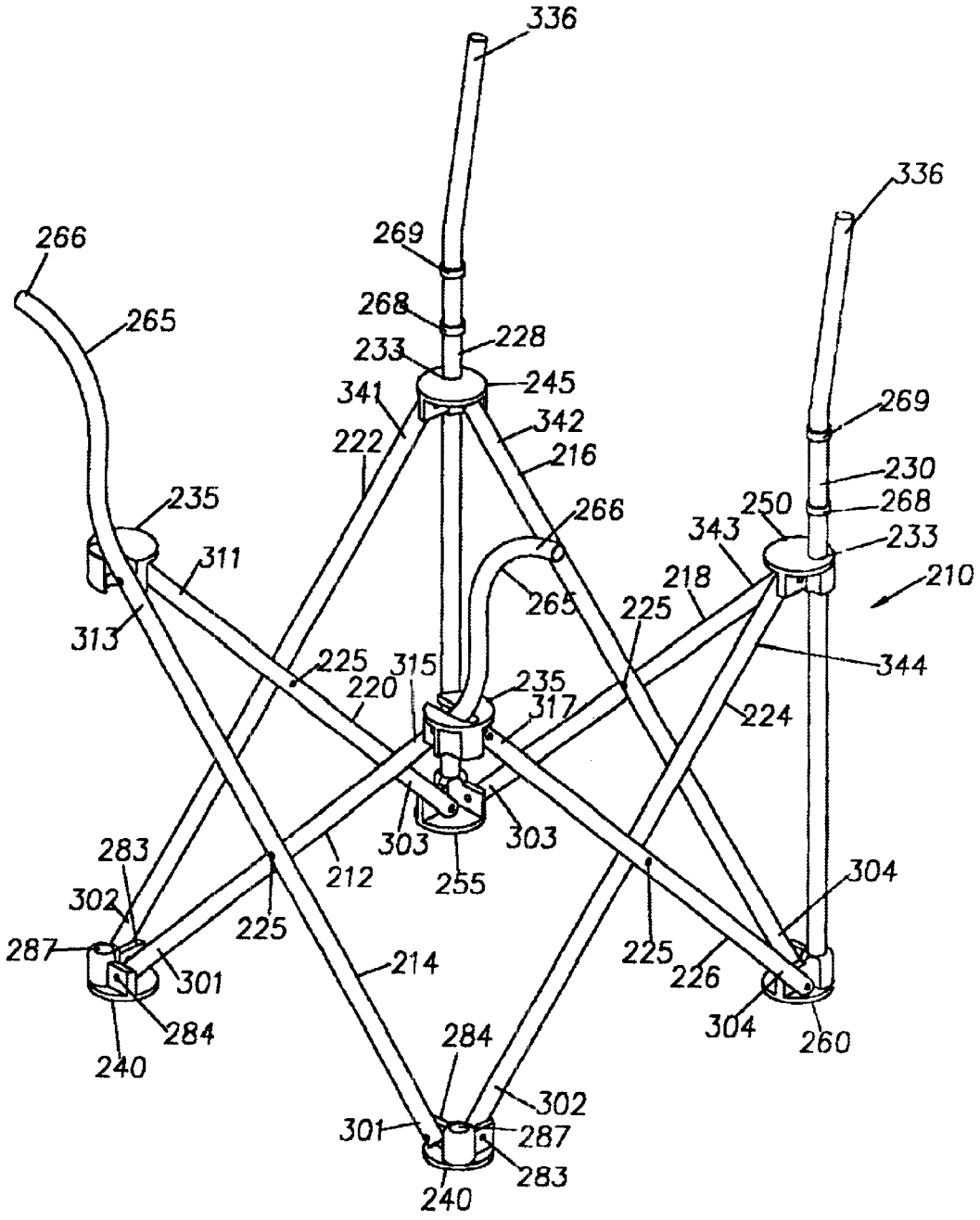
Figure 19:
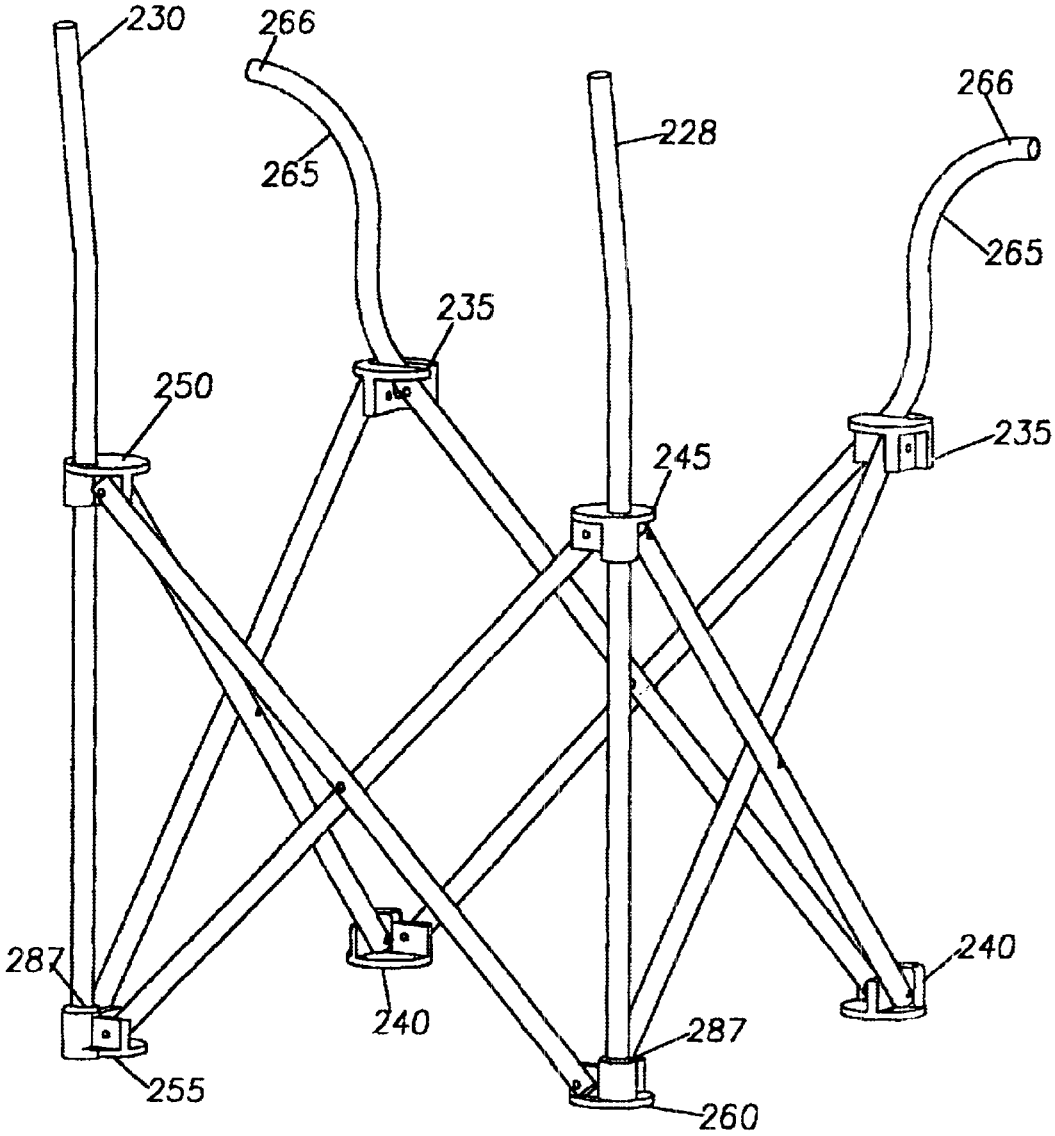
Figure 20:
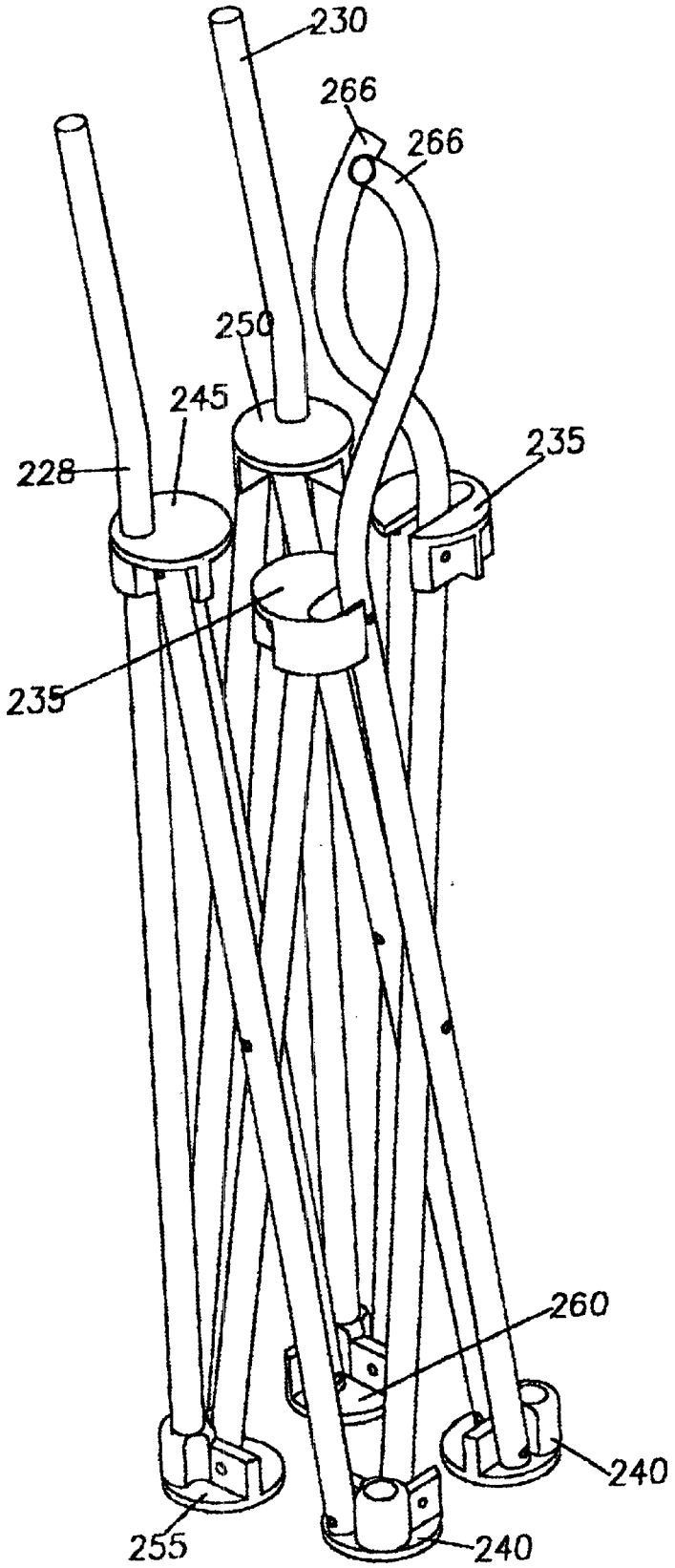
Figure 21:
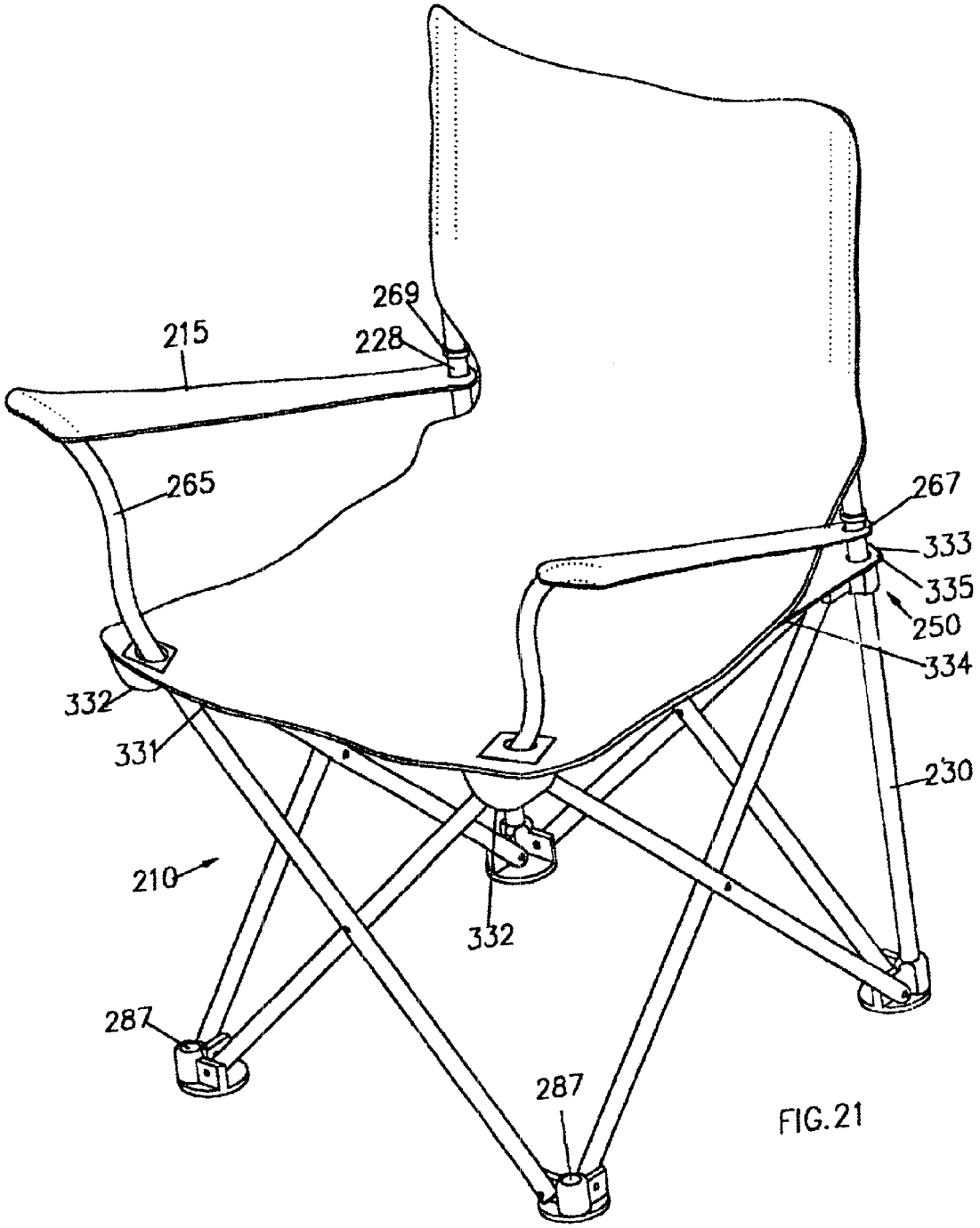
Figure 22A:
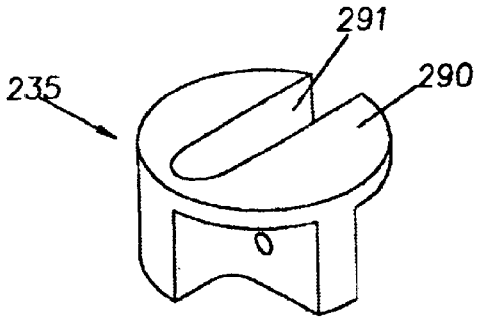
Figure 22B:
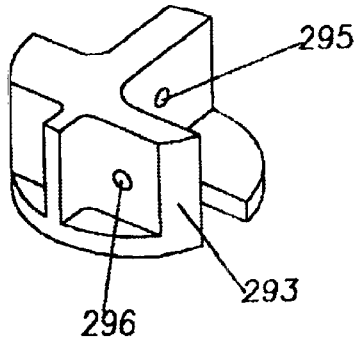
Figure 23A:
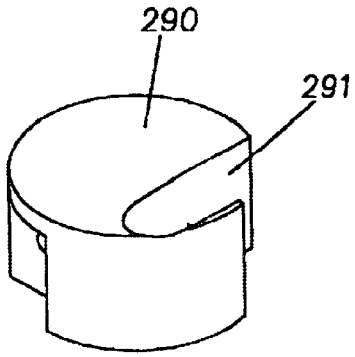
Figure 23B:
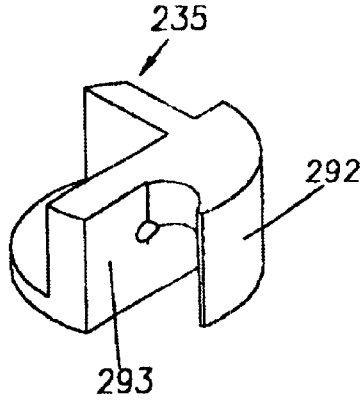
Figure 25B:
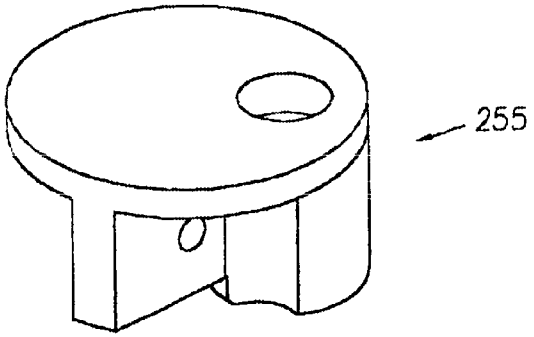
Figure 25A:
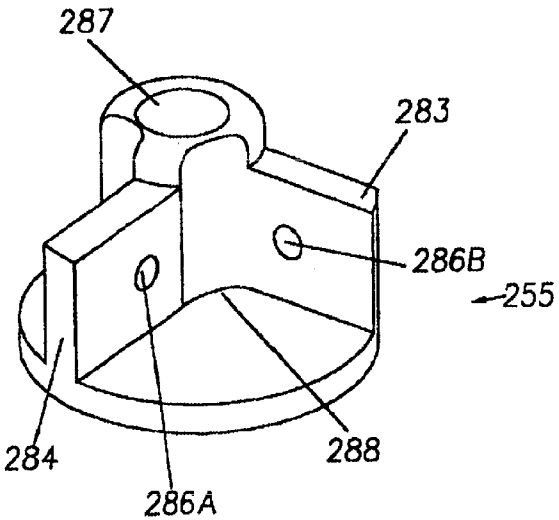
Figure 24B:
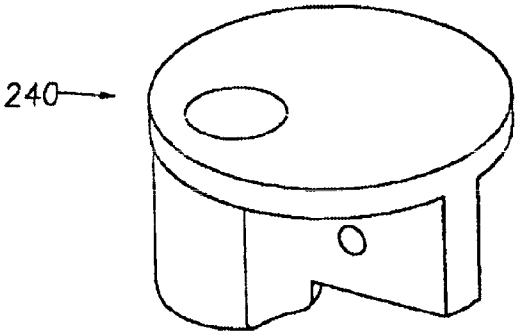
Figure 24A:
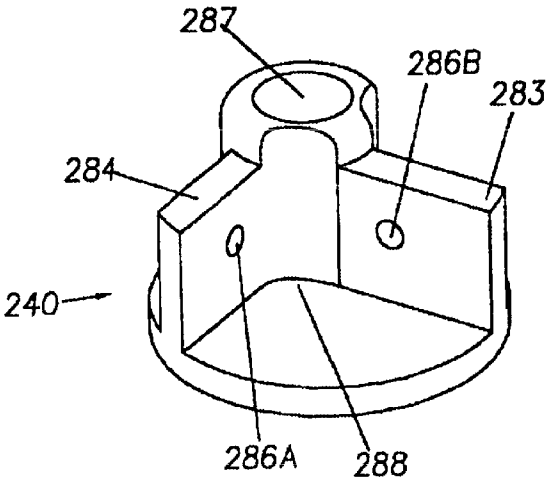
Figure 27A:
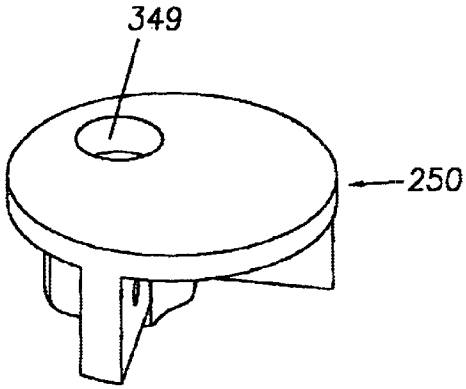
Figure 27B:
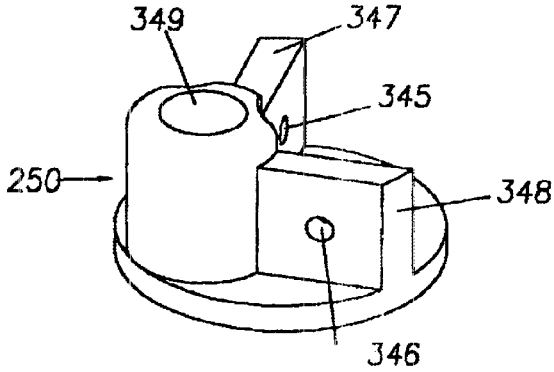
Figure 26A:
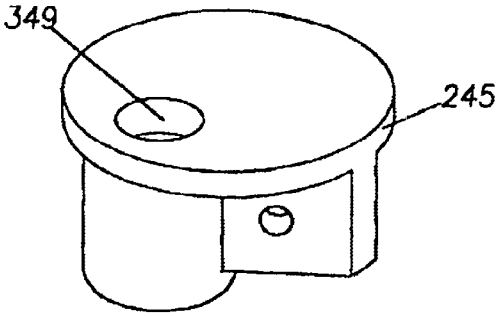
Figure 26B:
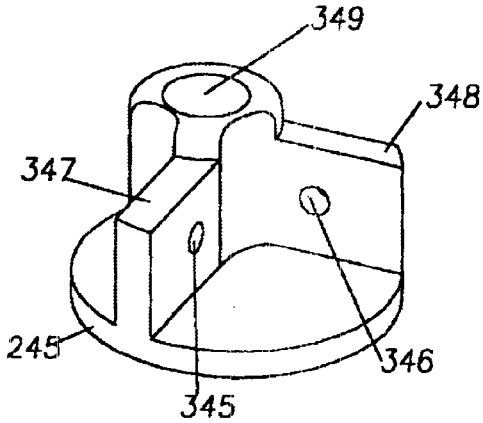

FIG. 18 is a front perspective view of the collapsible patio chair of the application Ser. No. 09/561,339, U.S. Pat. No. 6,322,138, invention in an unfolded position, with its seating fabric removed;

FIG. 19 is a rear perspective view of the patio chair in its unfolded position;

FIG. 20 is a front perspective view of the patio chair when fully collapsed, ready for storage;

FIG. 21 is a front perspective view of the collapsible patio chair in its unfolded position, with the seating fabric in place;

FIGS. 22A & 22B and 23A & 23B are top and bottom perspective views respectively of the front connectors of the patio chair of this Application;

FIGS. 24A & 24B are top and bottom perspective views respectively of the front connector pads;

FIGS. 25A & 25B are top and bottom views respectively of the rear connectors pads; and FIGS. 26A & 26B and 27A & 27B are top and bottom perspective views respectively of the rear connectors of the patio chair invention.

C. Ser. No. 09/593,938, U.S. Pat. No. 6,364,410, Collapsible Cot

Figure 28:
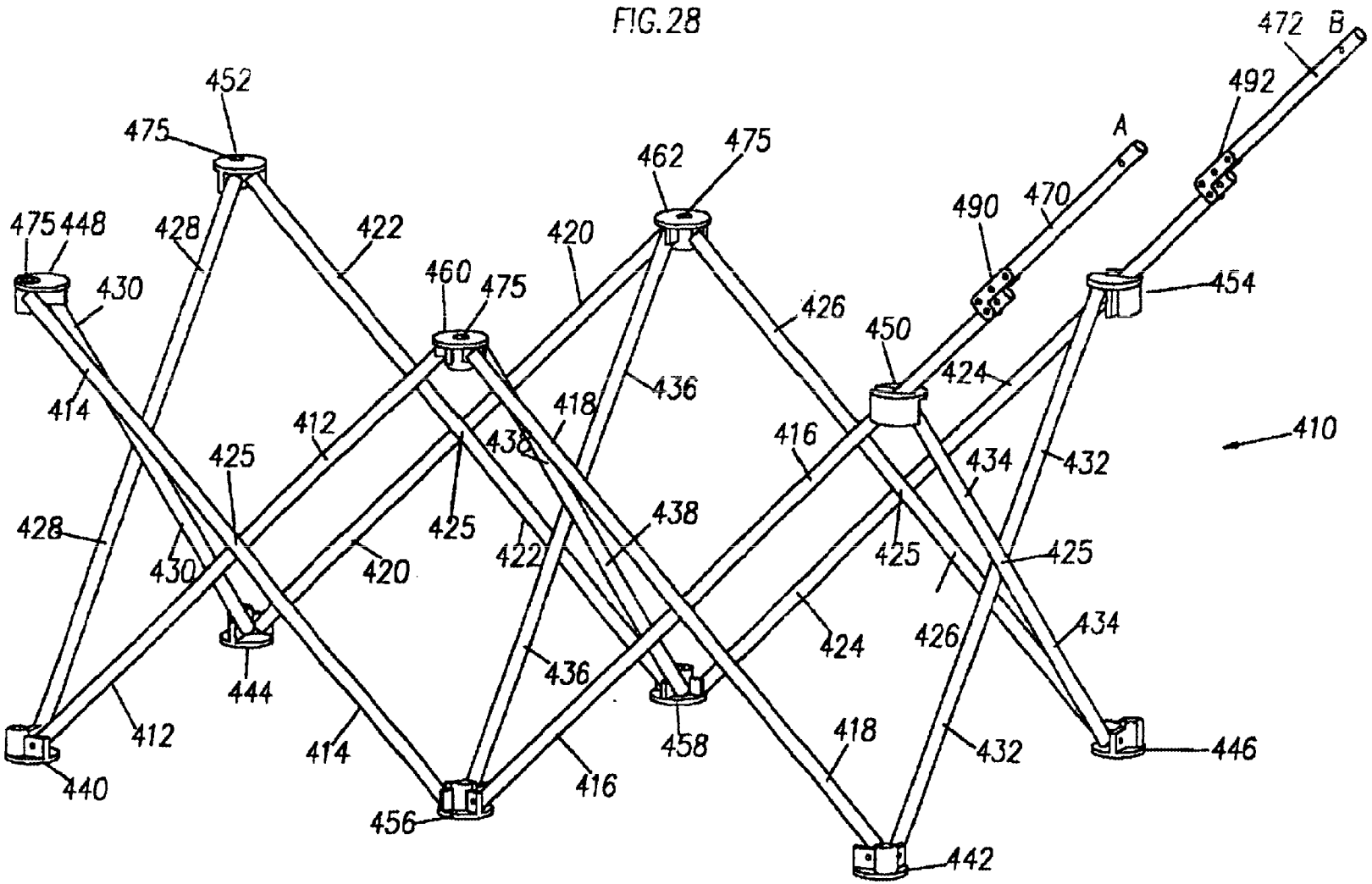
Figures 29A, 29B, 29C, 29D, 29E, 29F:
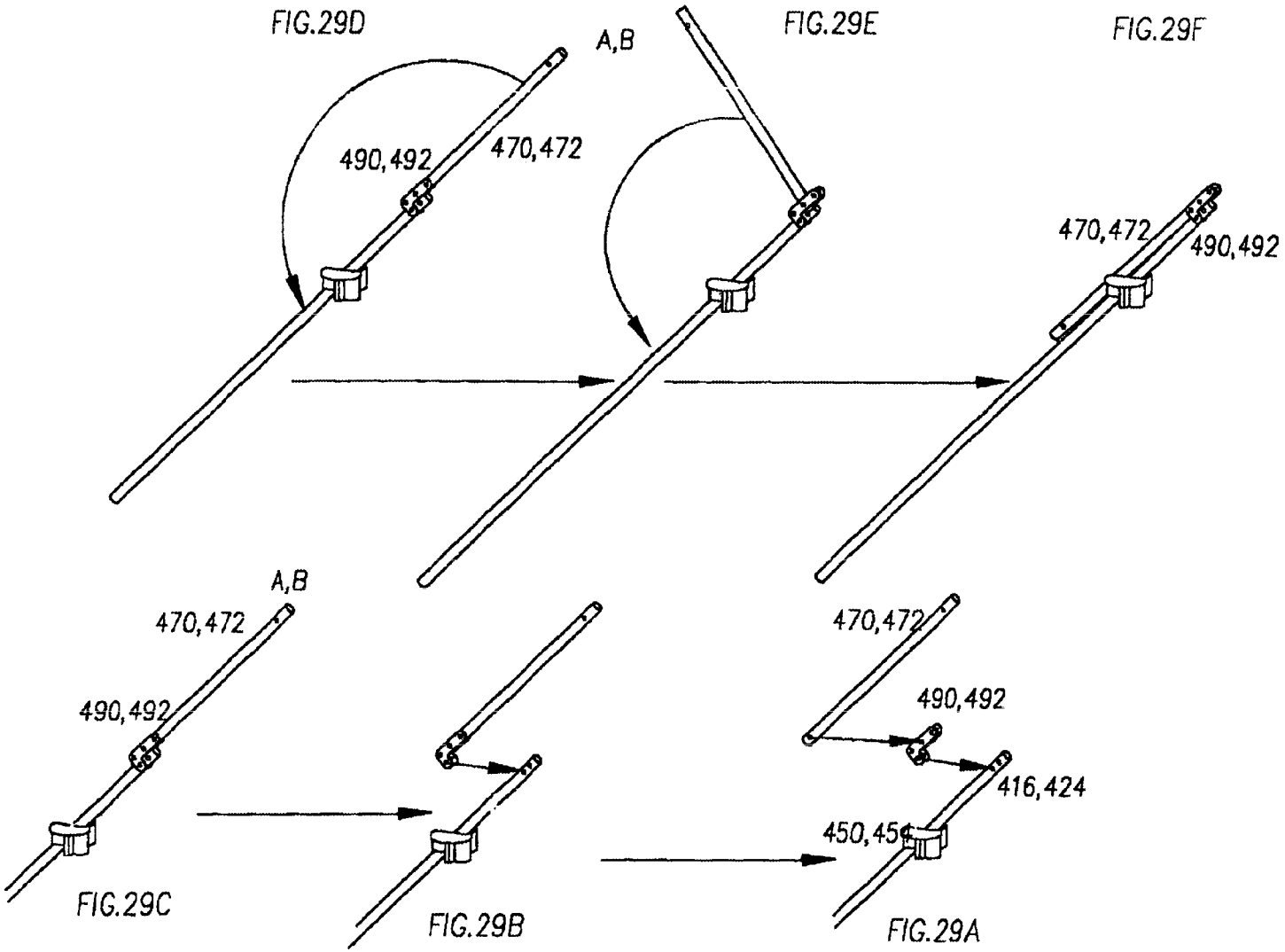
Figure 32B:
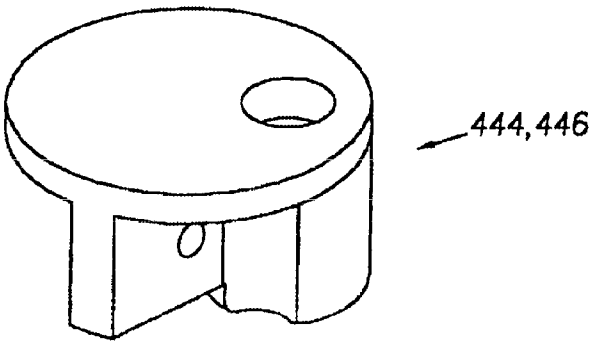
Figure 32A:
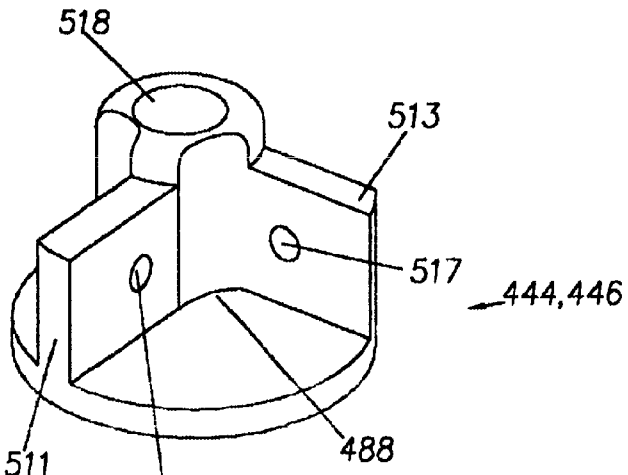
Figure 30B:
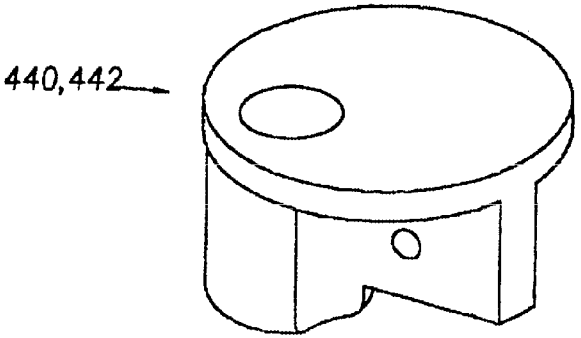
Figure 30A:
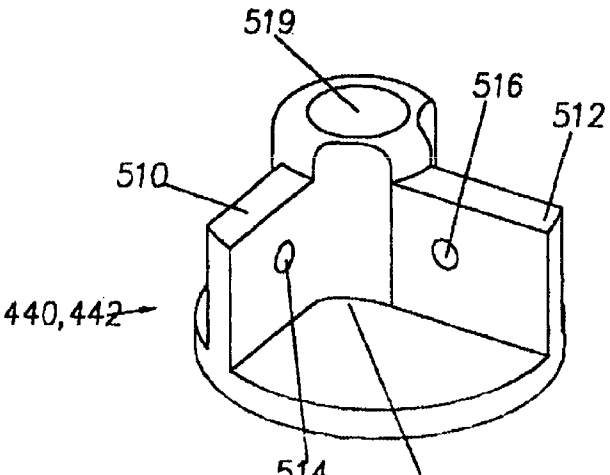
Figure 31B:
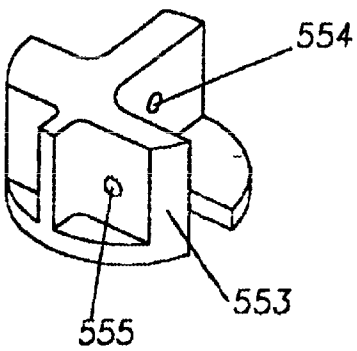
Figure 33B:
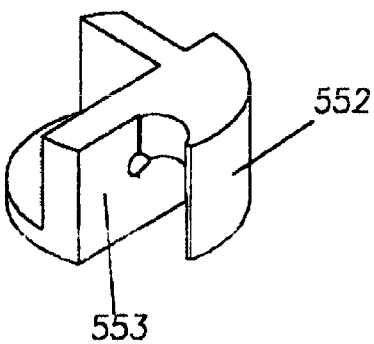
Figure 31A:
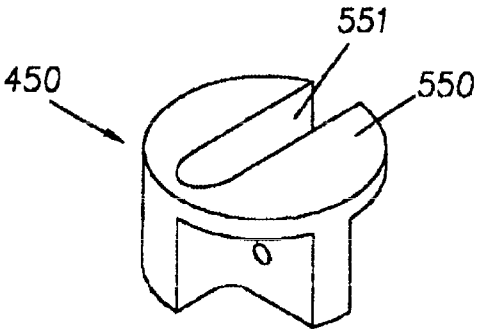
Figure 33A:
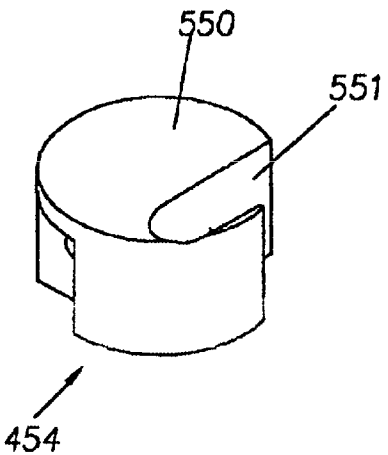
Figure 37B:
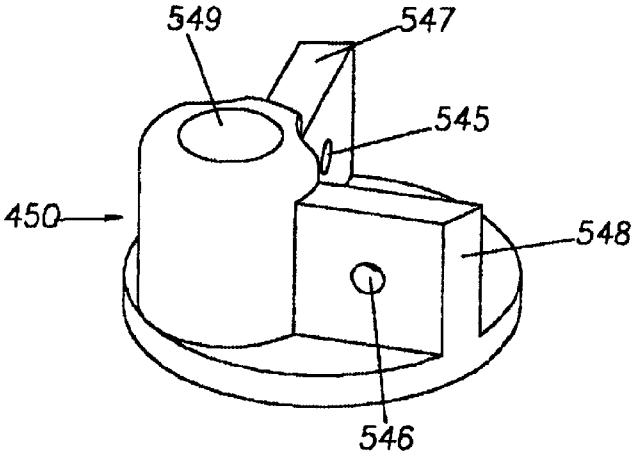
Figure 34B:
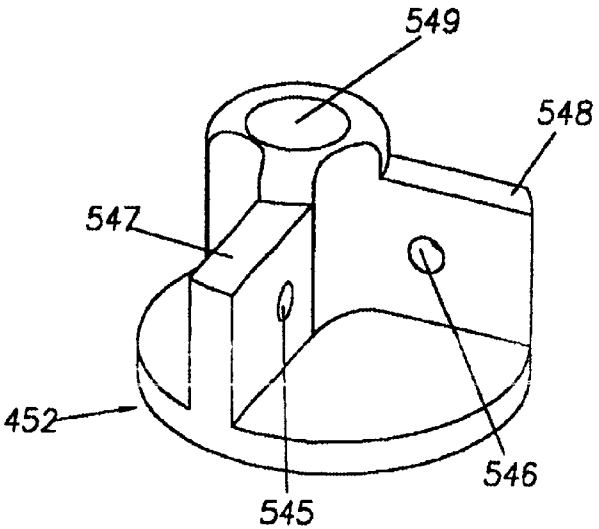
Figure 37A:
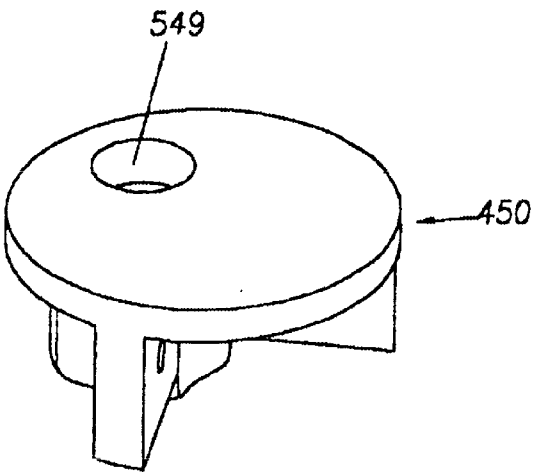
Figure 34A:
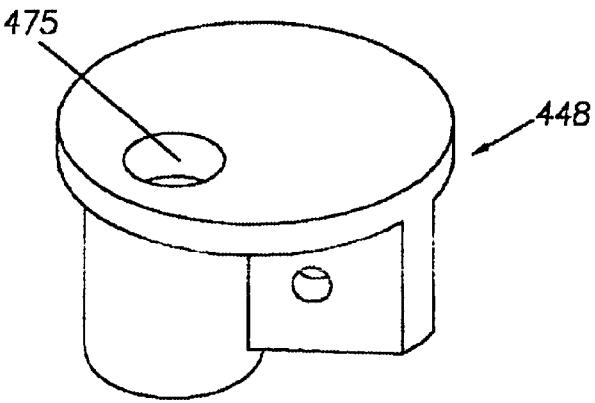
Figures 35, 36A, 36B:
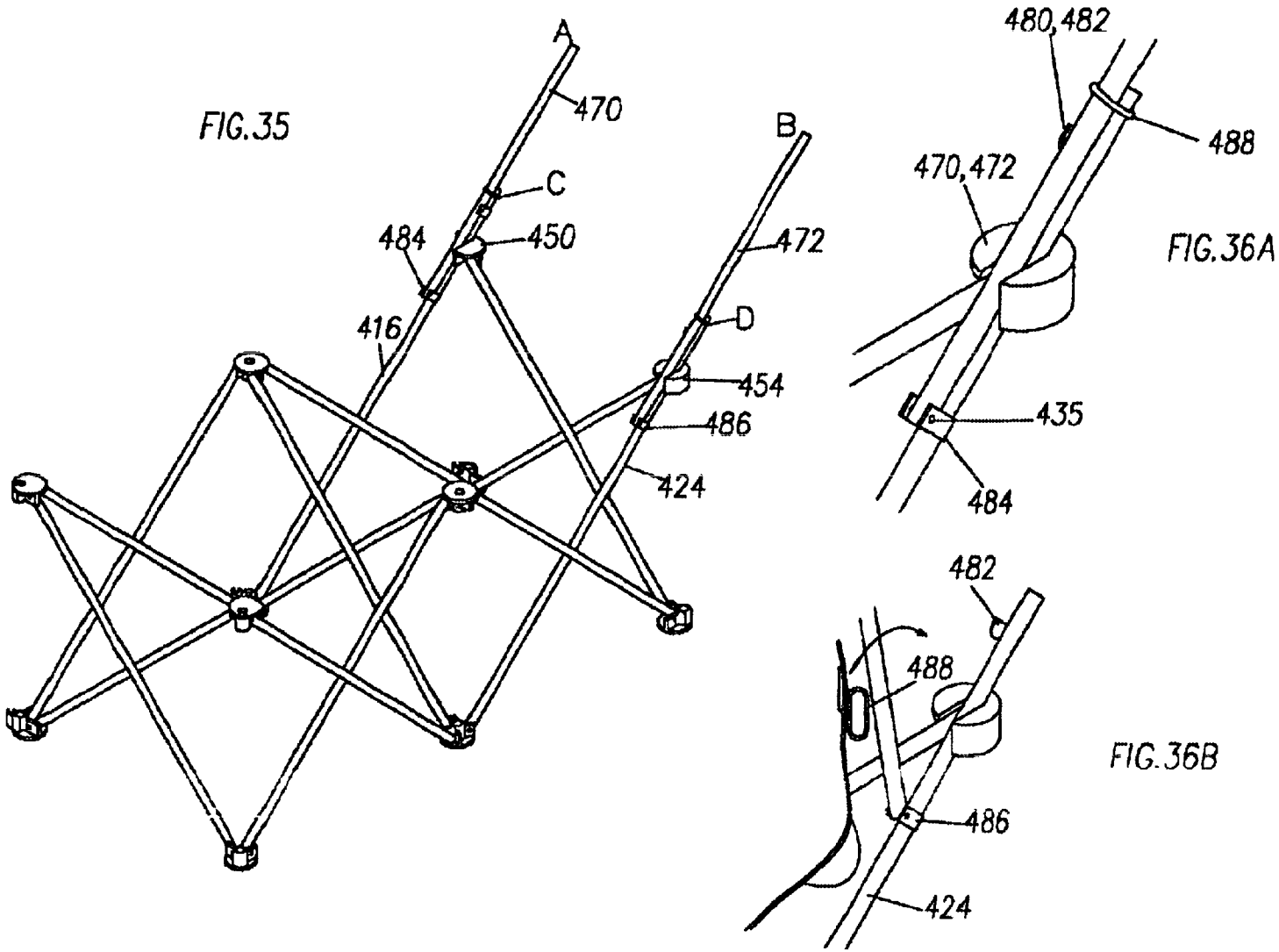
Figures 37, 38A, 38B, 38C:
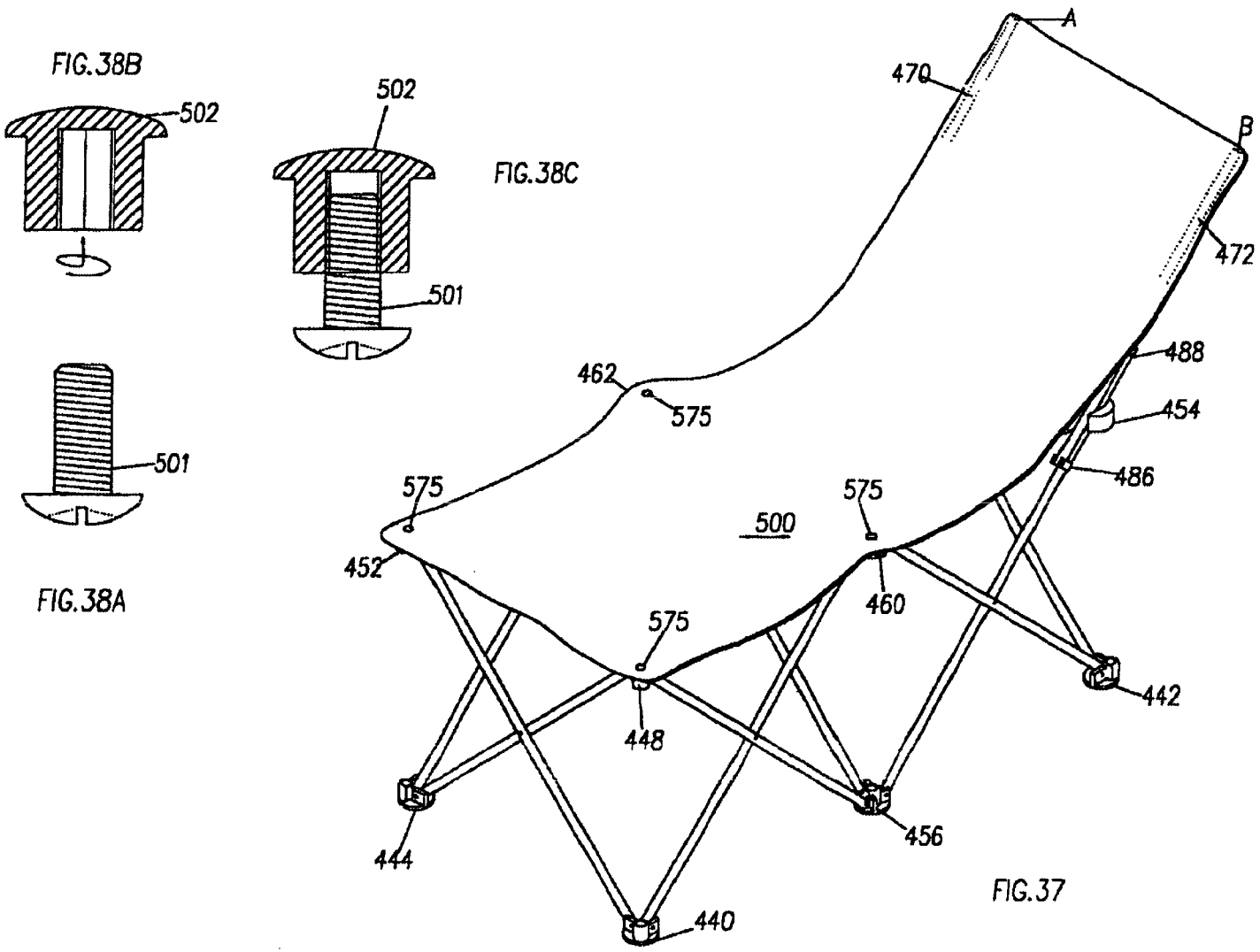

FIG. 28 is a front perspective view of the collapsible cot of the application Ser. No. 09/593,938, U.S. Pat. No. 6,364,410, invention in an unfolded position, with its seating fabric removed;

FIGS. 29A–29F are helpful in an understanding of the operation of the collapsible cot of FIG. 28;

FIGS. 30A & 30B are top and bottom perspective views, respectively, of two of the three front pad connectors of the collapsible cot;

FIGS. 31A & 31B are top and bottom perspective views, respectively, of a first front connector of the cot;

FIGS. 32A & 32B are top and bottom perspective views, respectively, of two of the three rear pad connectors of the cot;

FIGS. 33A & 33B are top and bottom perspective views, respectively, of the collapsible cot's first rear connector;

FIGS. 34A & 34B are top and bottom perspective views, respectively, of the cot's second front connector and second rear connector;

FIG. 35 is a front perspective view of the collapsible cot of this Application also in an unfolded position with its seating fabric removed, in accordance with a second construction of the cot;

FIGS. 36A & 36B are views helpful in an understanding of the construction of FIG. 35;

FIG. 37 illustrates the construction of the collapsible cot of FIG. 35 with the seating fabric in place, but is also helpful in an understanding of the installation of the seating fabric in the first construction of FIG. 28; and FIGS. 38A, 38B and 38C are sectional views helpful in understanding one manner of securing the seating fabric as a liner for the collapsible cot of FIG. 28.

D. Collapsible Pillow of the Present Invention

Figure 39:
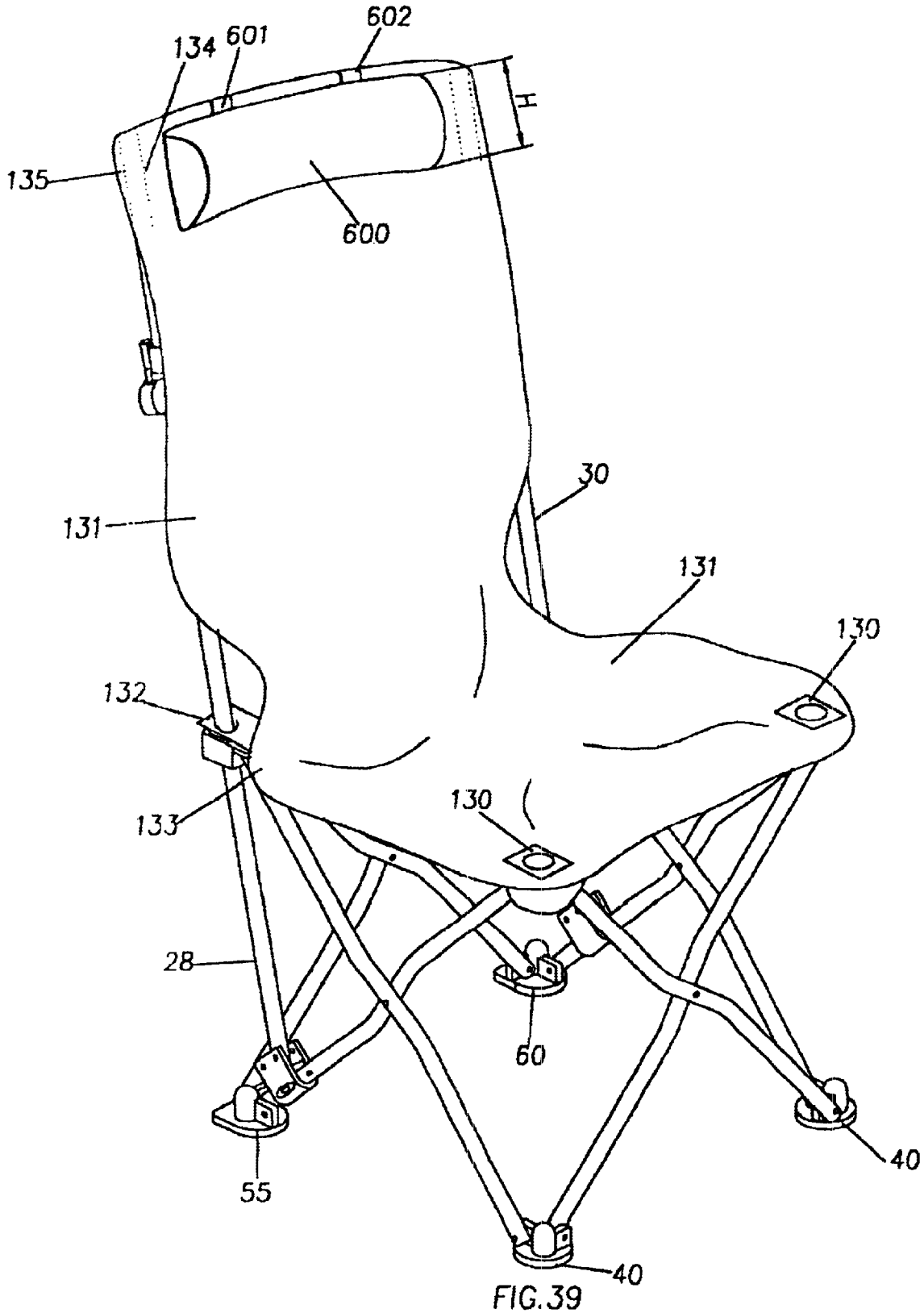
Figure 40:
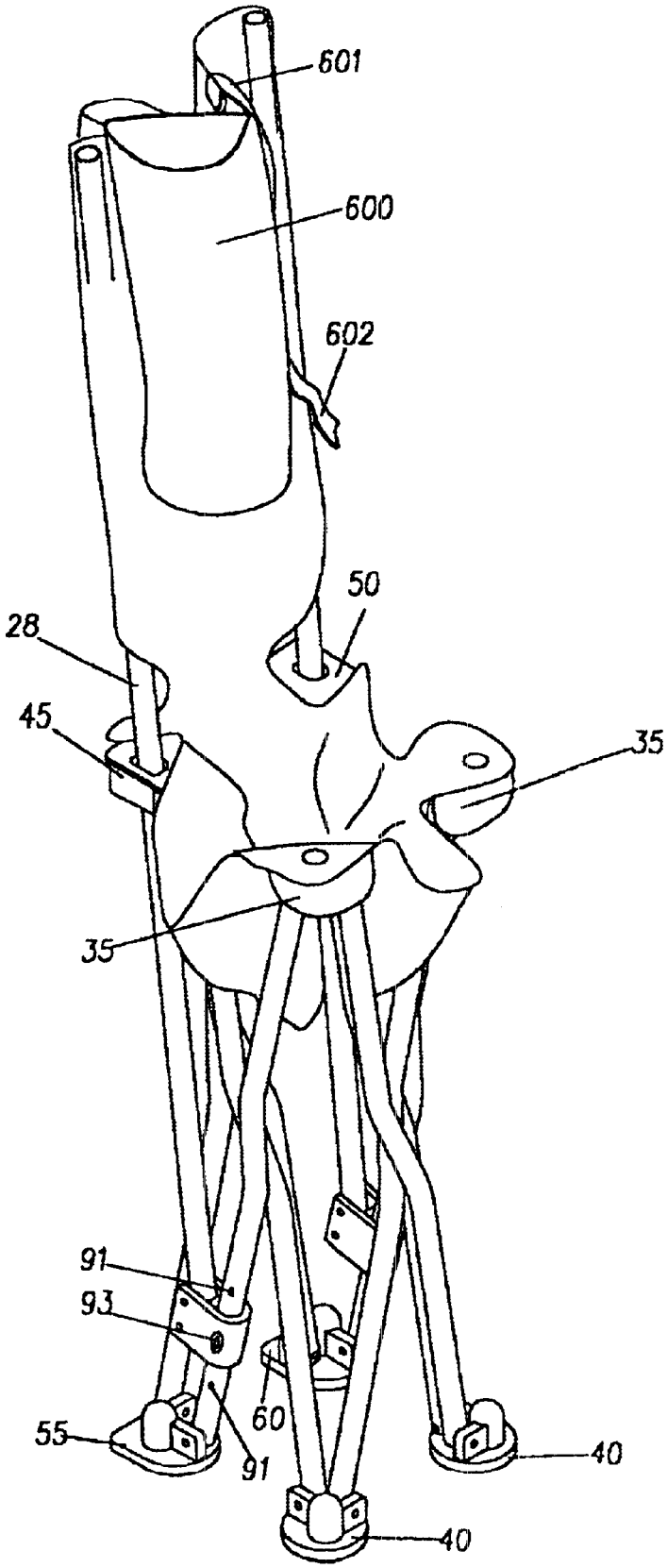
Figure 41B:
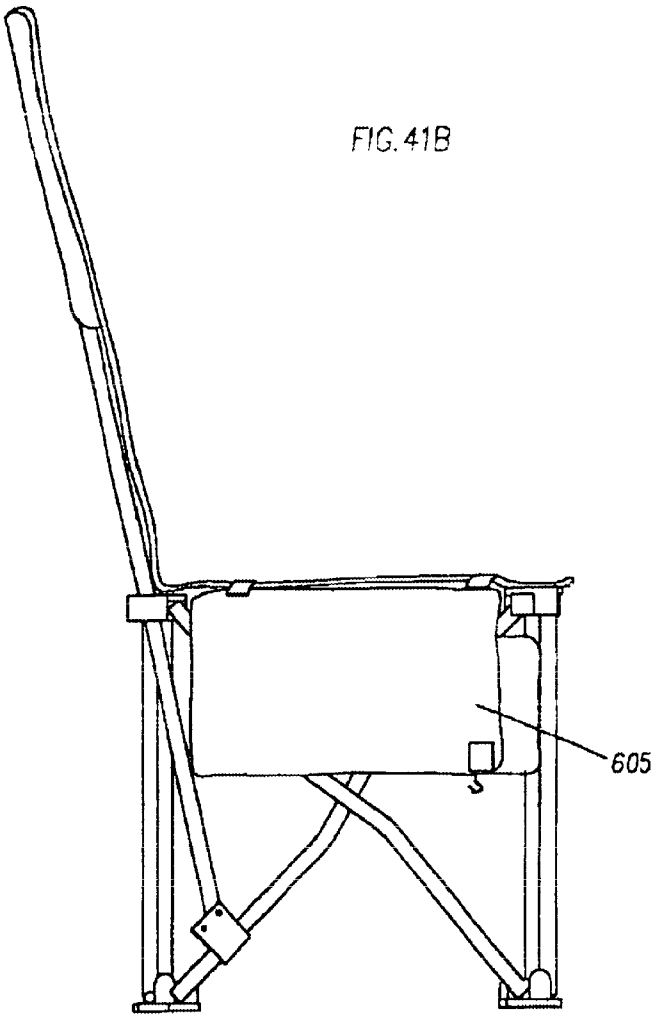
Figure 41A:
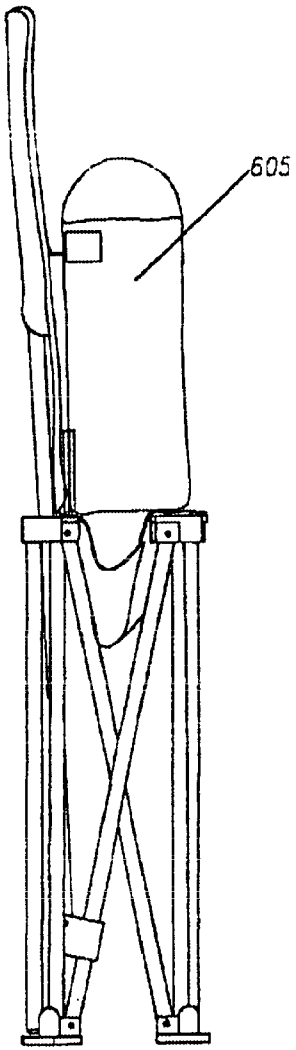

FIG. 39 is a front perspective view of the collapsible pillow of the invention as employed with a reclining lounger in its opened position;

FIG. 40 is a front perspective view of the pillow with the lounger of FIG. 39 in a closed position, with the fabric liner removed;

FIGS. 41A and 41B are schematic diagrams helpful in visualizing the folding and twisting of the pillow of the invention for storage within the collapsed lounger of FIG. 40;

FIGS. 42A–42D are schematic diagrams helpful in an understanding of the folding and twisting of the pillow into the collapsed lounger.

E. Collapsible Cooler/Utility Bag of the Present Invention

Figure 43:
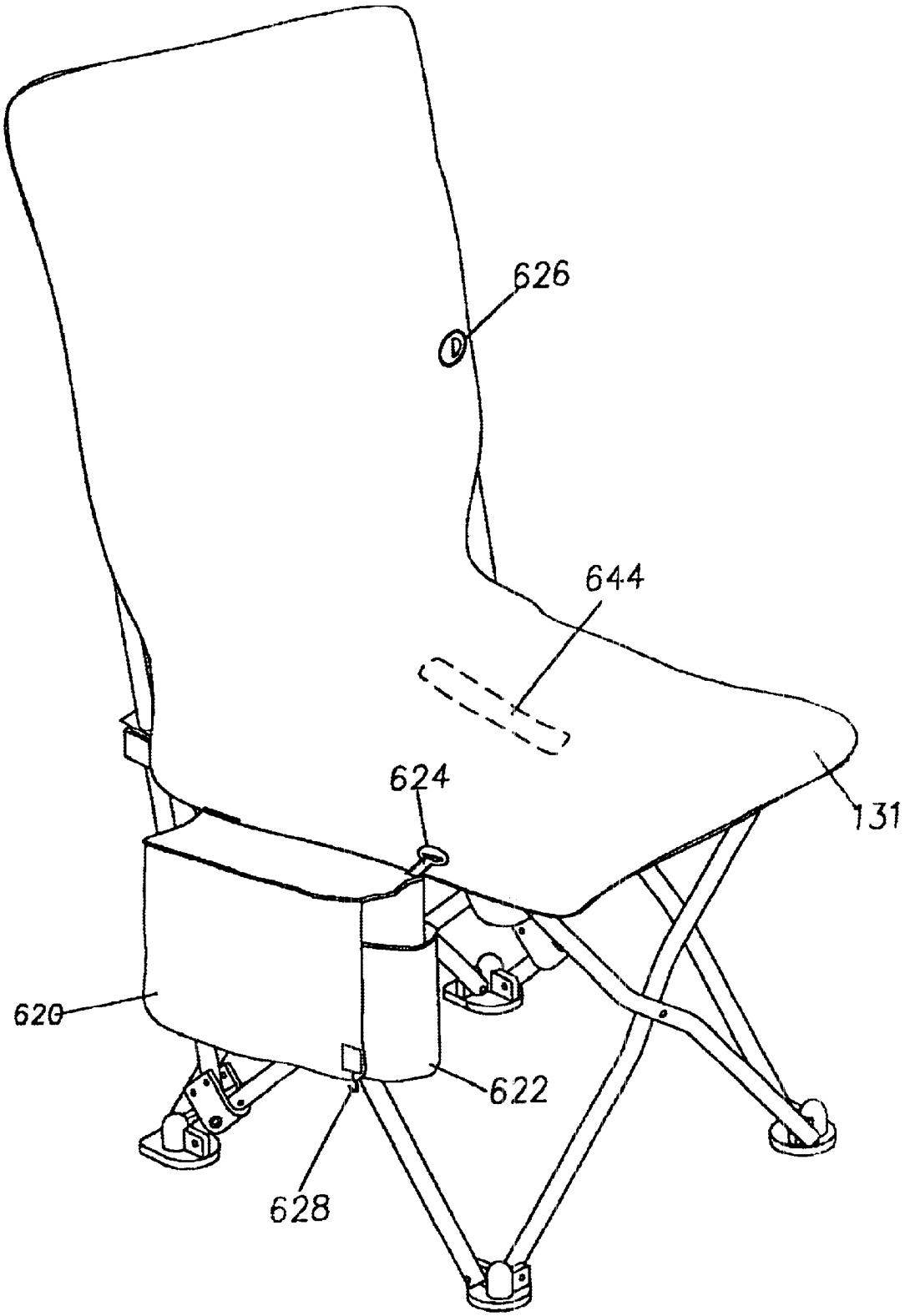
Figures 44, 44A, 44B, 44C, 44D:
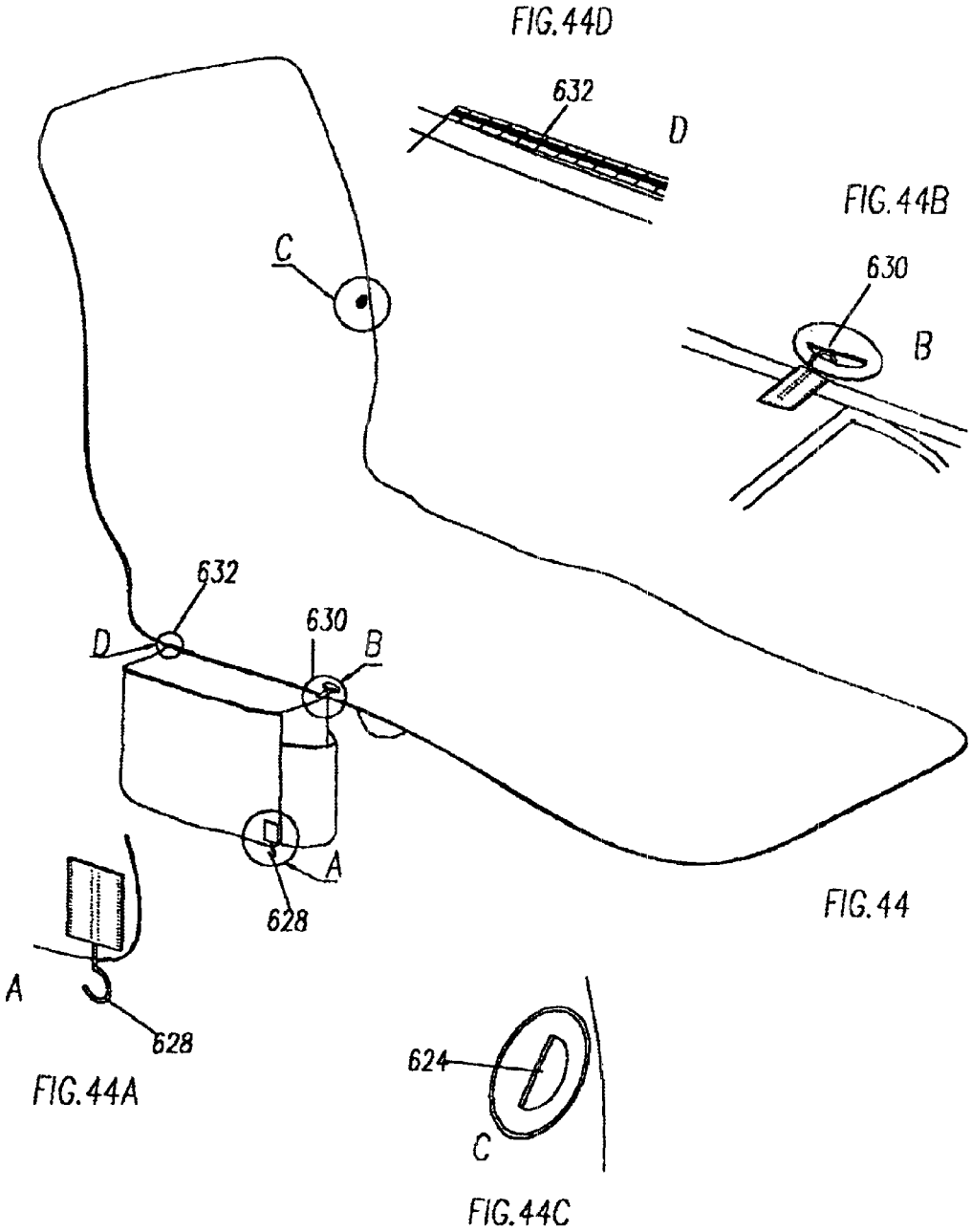
Figure 46:
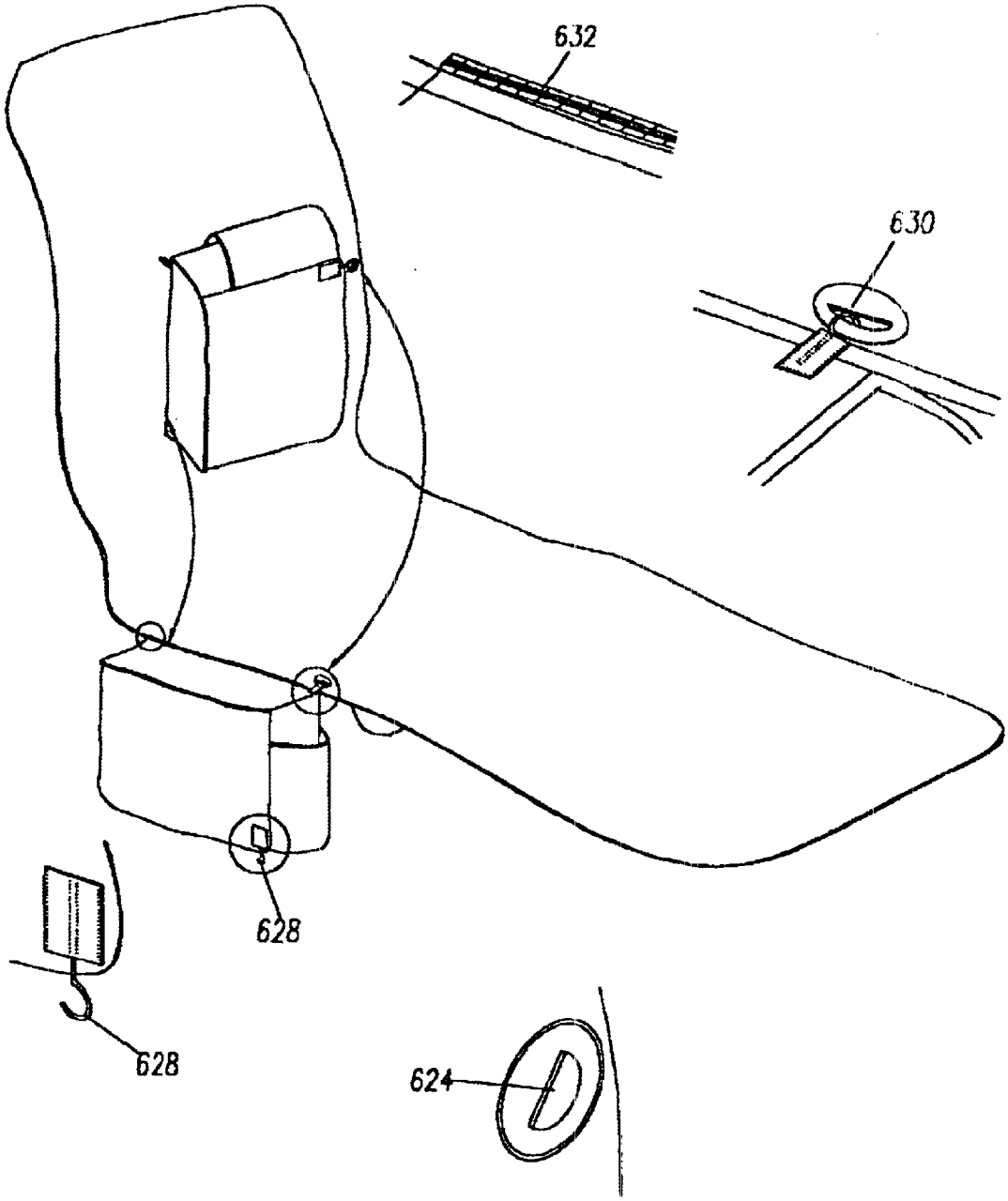

FIG. 43 is a front perspective view of the cooler/utility bag of the present invention as employed with a reclining lounger in its opened position;

FIGS. 44 and 44A–44D are perspective and detail views showing a manner of attaching the cooler/utility bag to the fabric liner;

FIGS. 45A–45D are schematic diagrams helpful in understanding a manner of folding and twisting the cooler/utility bag for storage with the lounger;

FIG. 46 is a front perspective view of the lounger of FIG. 44 showing the cooler/utility bag when folded into position.

F. Collapsible Arm Rest of the Present Invention

Figure 1:
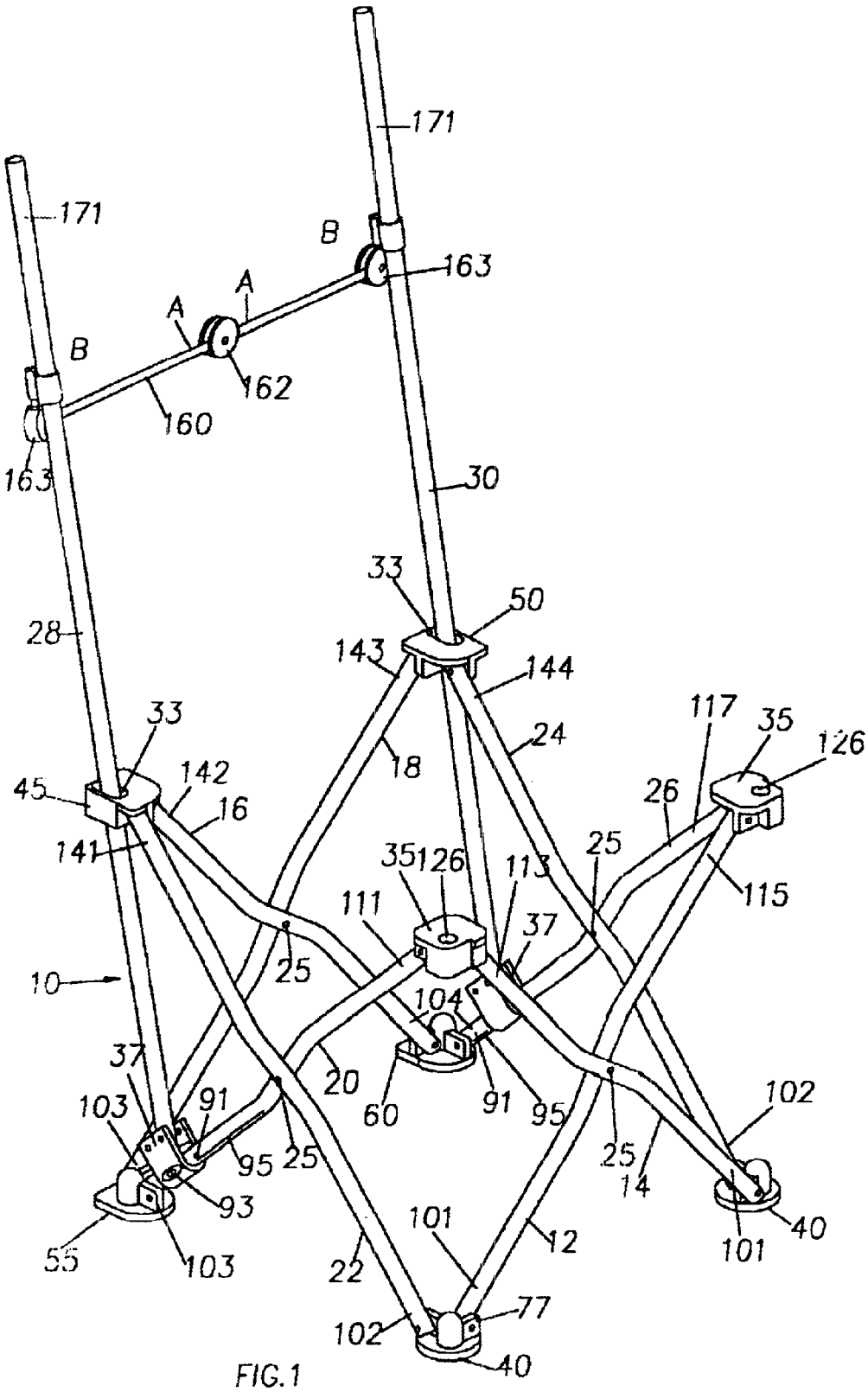
FIG. 1 is a front perspective view of the collapsible reclining beach chair or lounger of the application Ser. No. 09/551,664, U.S. Pat. No. 6,179,374 invention in an unfolded position, with its seating fabric removed.
Figure 47:
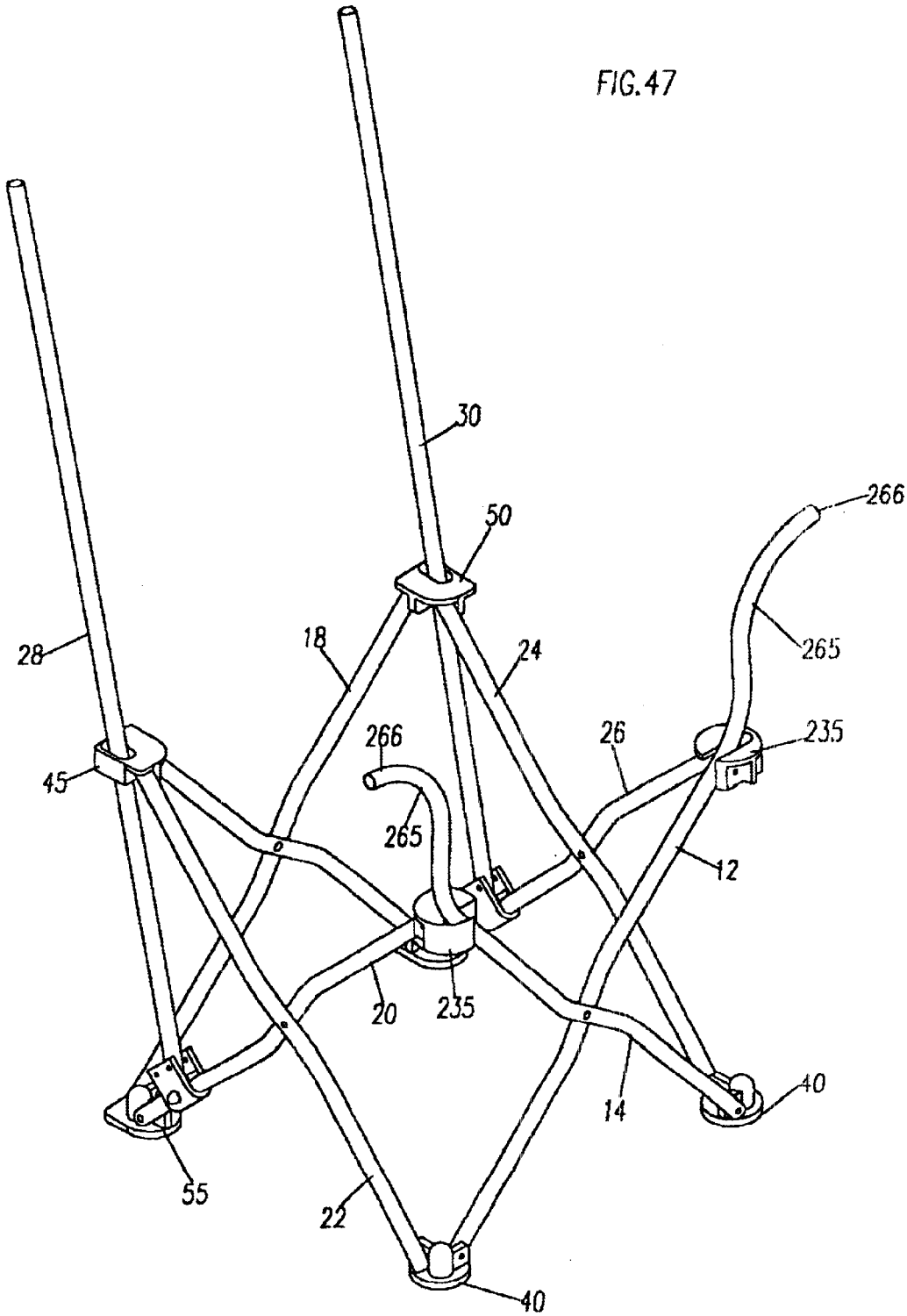
Figure 48:
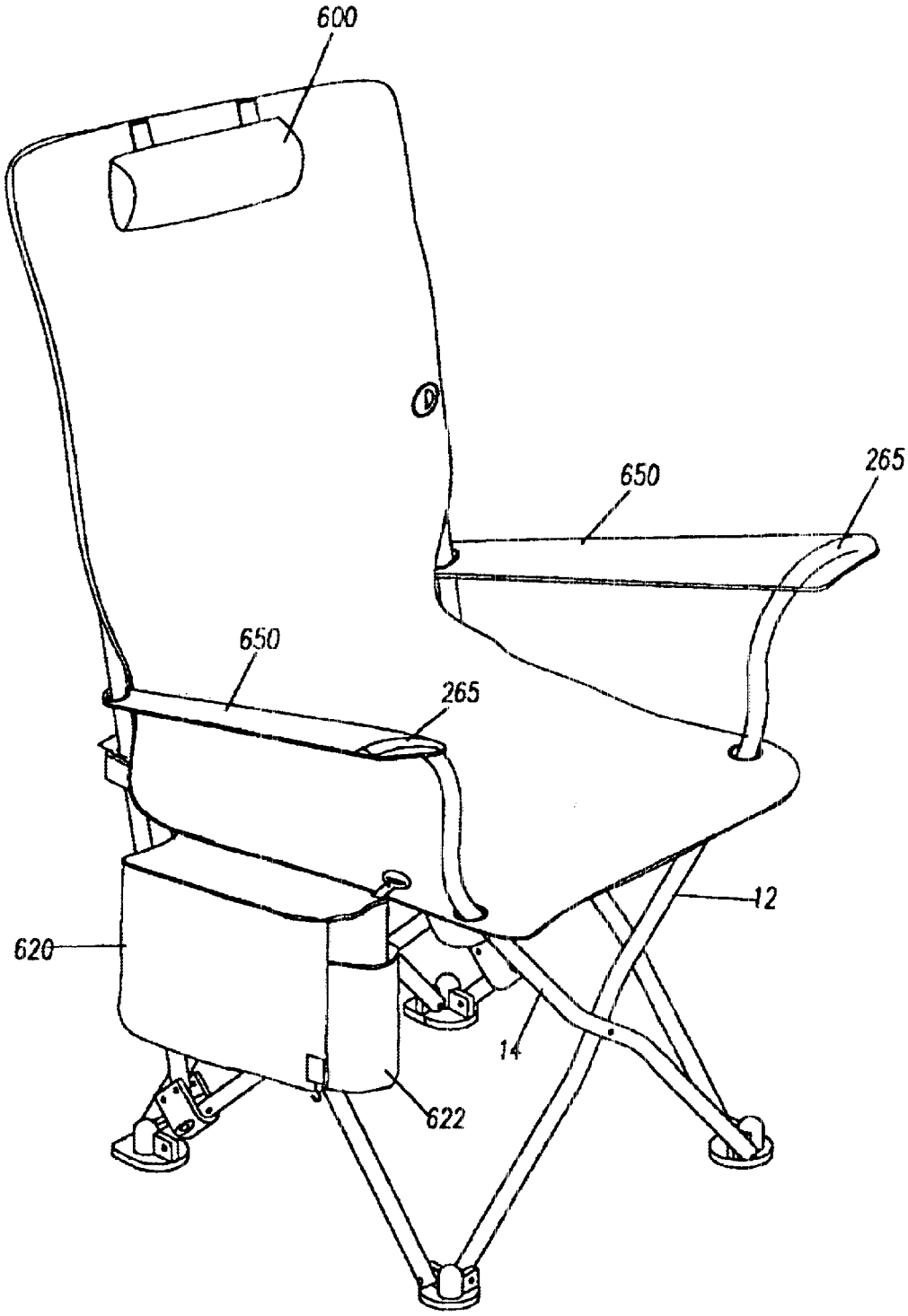
Figure 50:
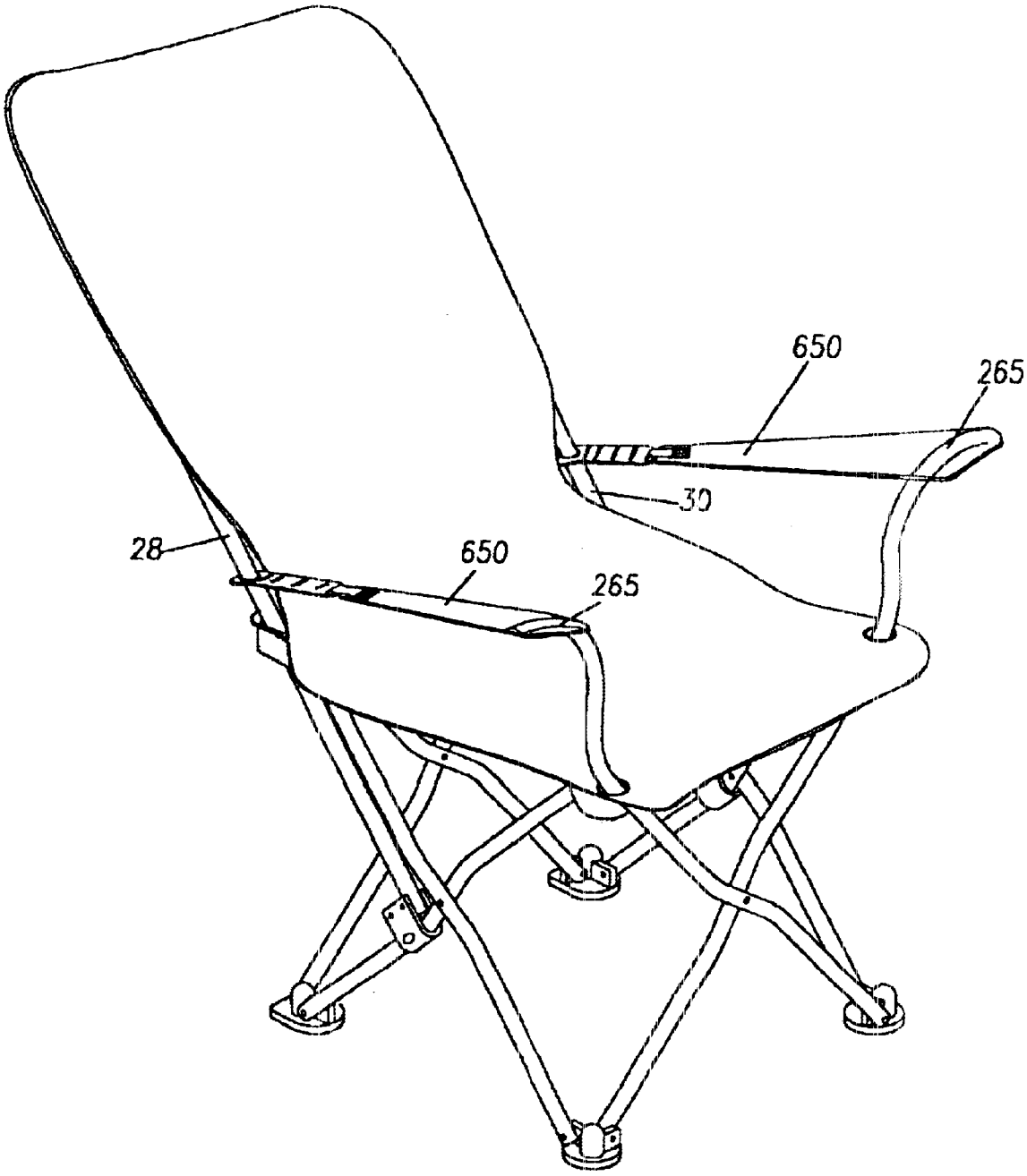

FIG. 47 is front perspective view of the collapsible reclining lounger of FIG. 1 as modified to accept the hand rest of the present invention;

FIG. 48 is a front perspective view of the lounger of FIG. 47 with its fabric liner in place, showing the hand rest of the present invention, along with the collapsible pillow and collapsible utility/cooler bag of FIGS. 39–42 and 43–46, respectively;

FIGS. 49 and 50 are front perspective views of the lounger with the arm rest of the invention in one of two possible positions of adjustable length;

FIGS. 51–54 illustrate a first embodiment of the invention in adjusting the arm rest to the lengths and positions shown in FIGS. 49 and 50;

FIG. 55 illustratively shows a second embodiment for adjusting the arm length of the lounger, according to the invention;

FIG. 56 is a front perspective view of the lounger employing the adjustable length arm rest of FIG. 55.

G. Collapsible Foot Rest of the Present Invention

Figure 57:
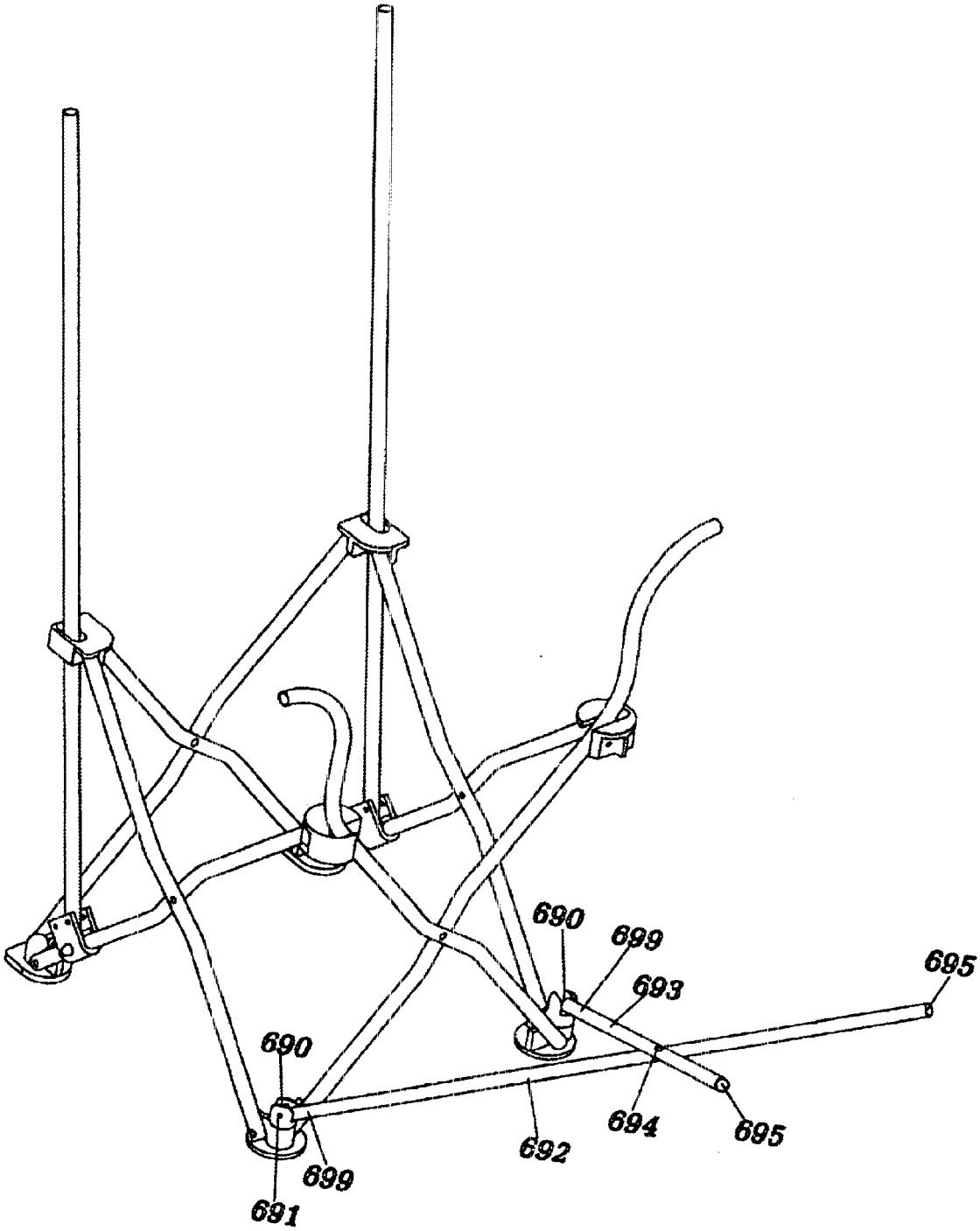
Figure 58:
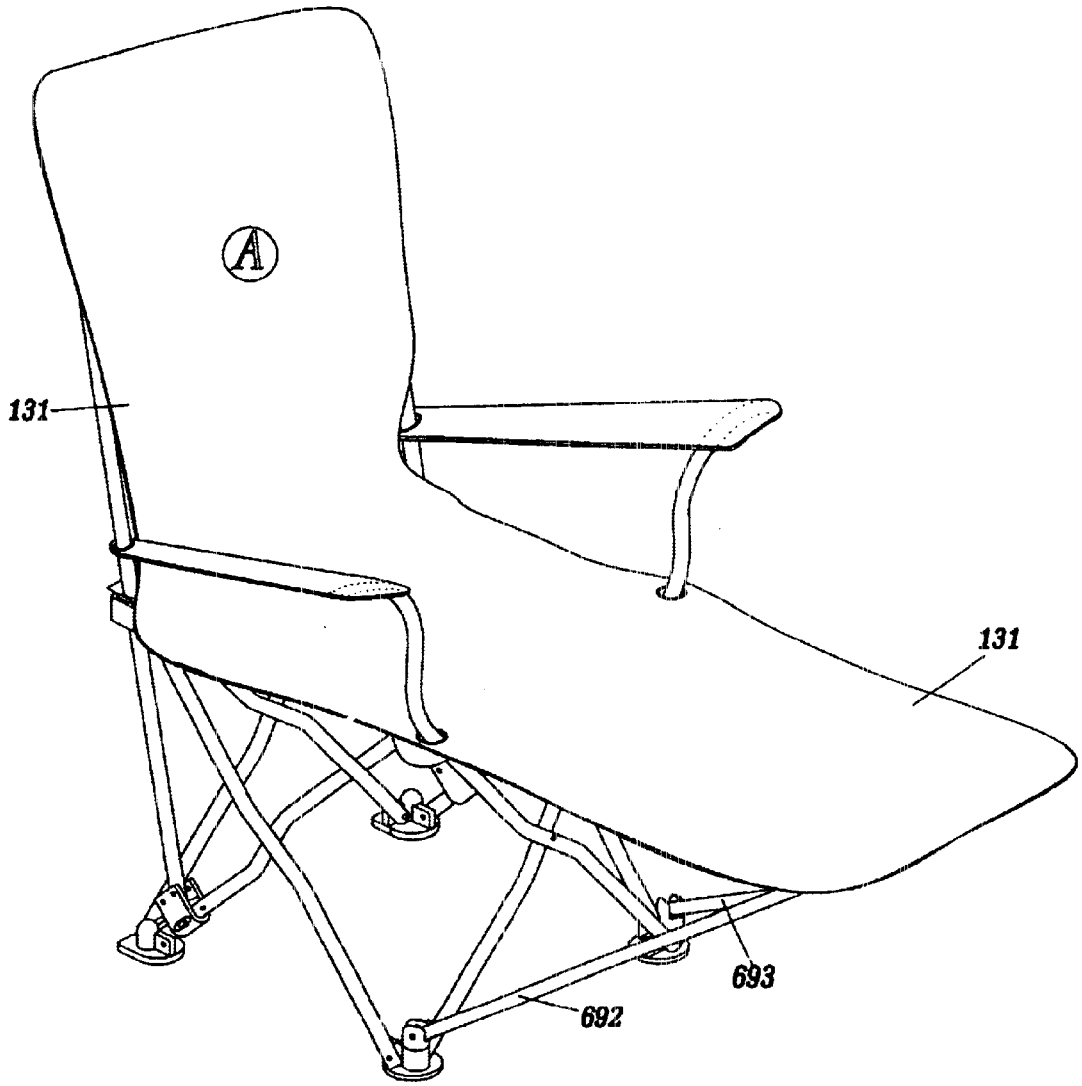
Figure 59:
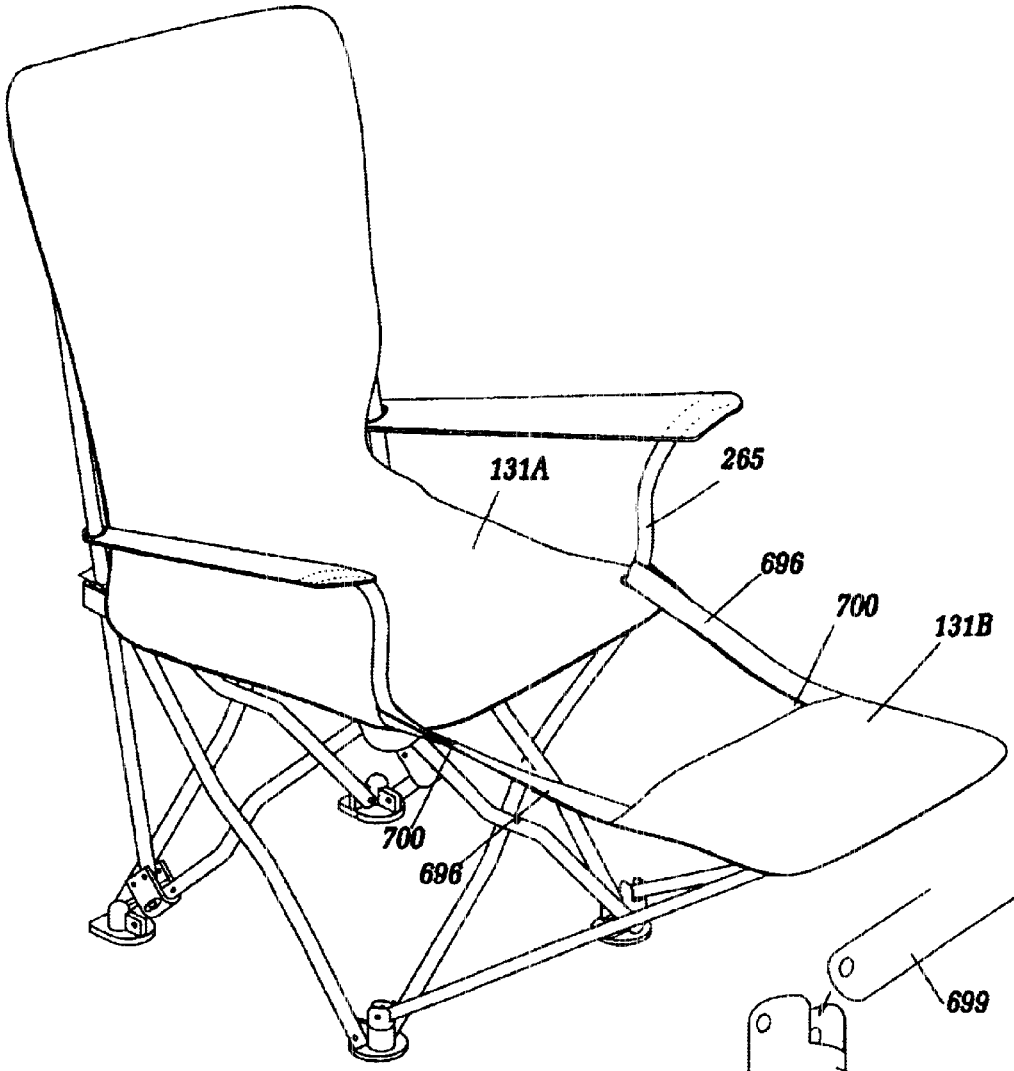
Figure 60:
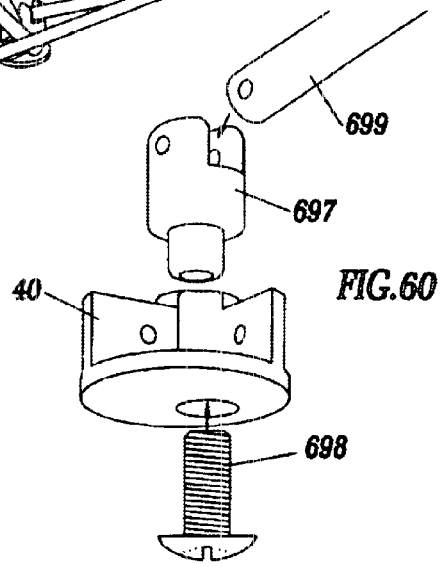

FIG. 57 is a front perspective view of the lounger of FIG. 47, modified to include the foot rest of the present invention;

FIG. 58 is a front perspective view of the lounger of FIG. 57 as it would employ a 1-piece fabric liner construction;

FIG. 59 is a front perspective view of the lounger of FIG. 57 as it would appear with a 2-piece fabric liner; and FIG. 60 illustrates a manner of securing the foot rest of the present invention to the lounger in converting the lounger from the appearance of FIG. 47 to the appearance of FIG. 57.

DETAILED DESCRIPTION OF THE INVENTION

A. Ser. No. 09/551,664, U.S. Pat. No. 6,179,374, Collapsible Reclining Beach Chair As with the folding chair of U.S. Pat. No. 5,984,406, the collapsible reclining beach chair or lounger of the application Ser. No. 09/551,664, U.S. Pat. No. 6,179,374 invention is constructed out of tubular members. In FIG. 1, the frame of the beach chair 10 includes eight crossed legs in pairs of two each—front legs 12, 14, rear legs 16, 18, and side legs 20, 22 and 24, 26. As illustrated, each of the pairs 12 & 14, 16 & 18, 20 & 22 and 24 & 26 are joined together by pivot pins 25. The frame 10, furthermore, includes a pair of side supports 28, 30—which, like the crossed legs 12 & 14, 16 & 18, 22 and 24 are tubular, and are constructed of aluminum or steel. The side legs 20 and 26, on the other hand, are constructed of extruded aluminum tubing, the reason for which is explained below.

Figure 2:
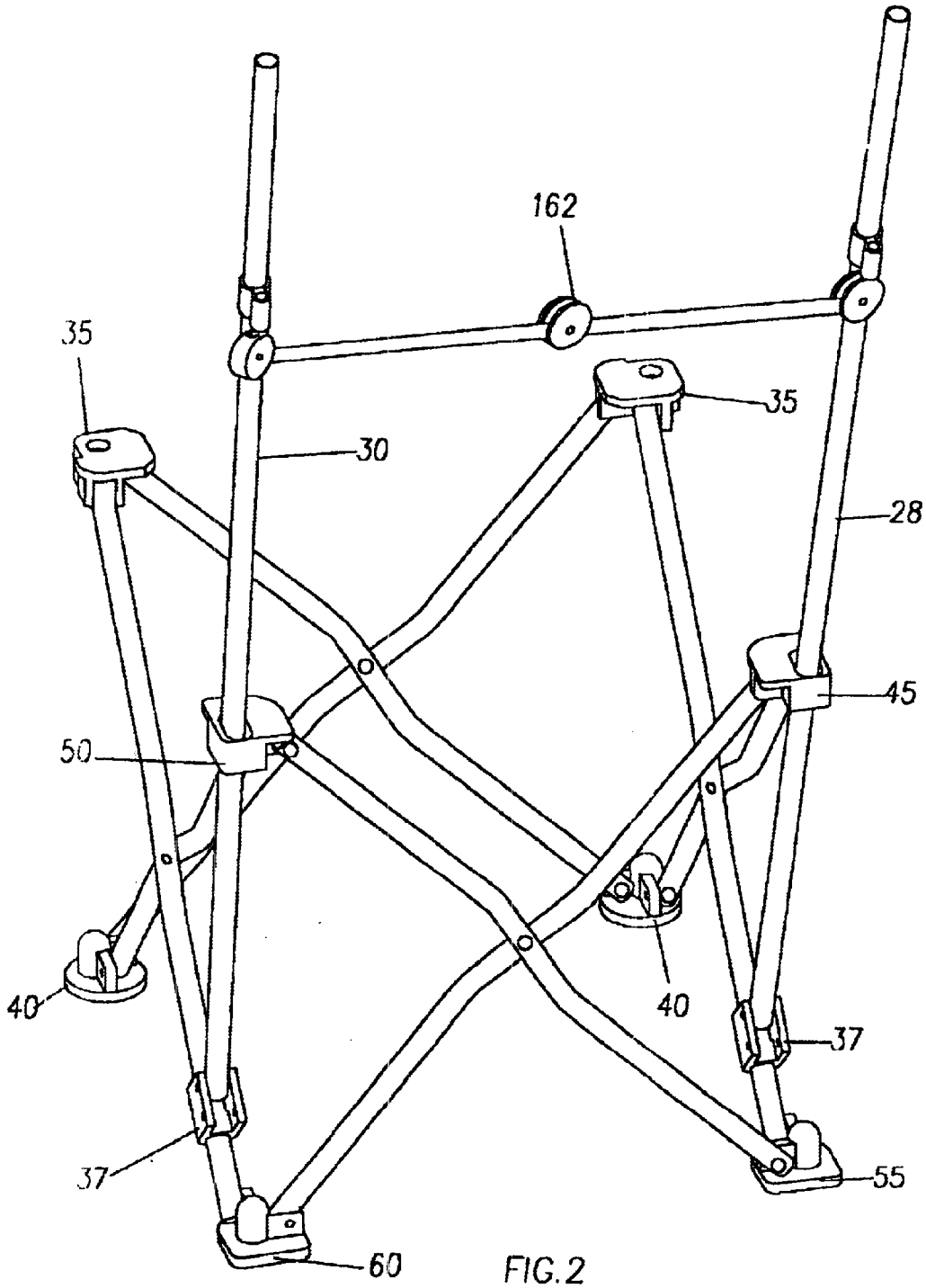
FIG. 2 is a rear perspective view of the reclining beach chair in its unfolded position.
Figure 3:
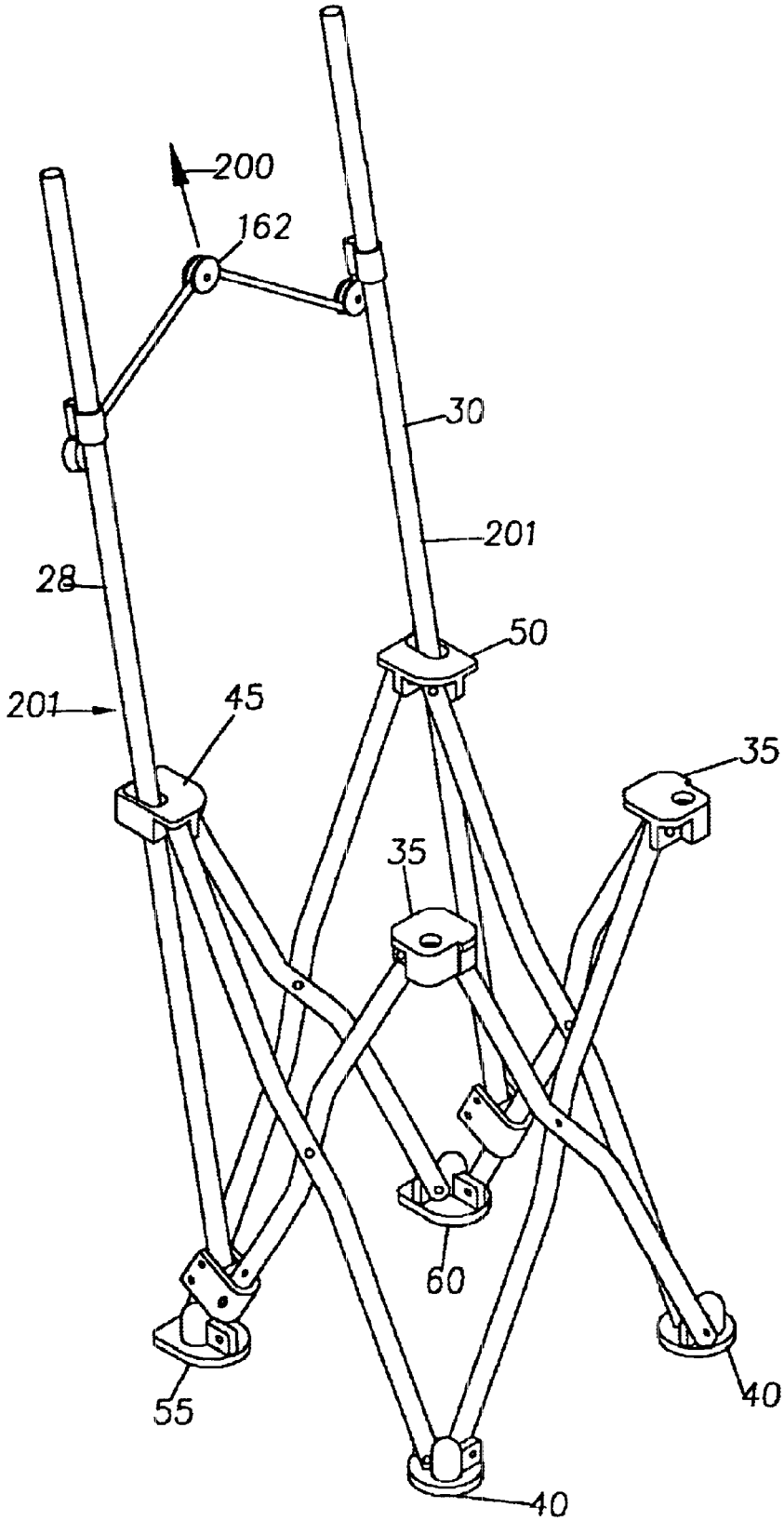
FIG. 3 is a front perspective view of the chair as it is being collapsed.

A pair of front connectors 35 join the crossed legs 14 & 20 and 12 & 26 together at their upper ends. A pair of front pad connectors 40 join the crossed legs 12 & 22 together, as well as the crossed legs 14 & 24, at their bottom ends. Similarly, two rear connectors 45, 50 respectively connect the upper ends of crossed legs 16 & 22 and 18 & 24 at their upper ends. Two rear pad connectors 55, 60 respectively join the lower ends of the crossed legs 18 & 20 and 16 & 26. As shown in FIGS. 1–3, the side supports 28, 30 respectively extend downwardly through apertures 33, in the rear connectors 45, 50, to couple with a sliding lock mechanism 37 arranged to move linearly along the legs 20 and 26. As will be described below, the position of the lock mechanism along the legs 20, 26 sets the angle of recline of the chair frame 10, where it is positively secured in place.

Figure 17:
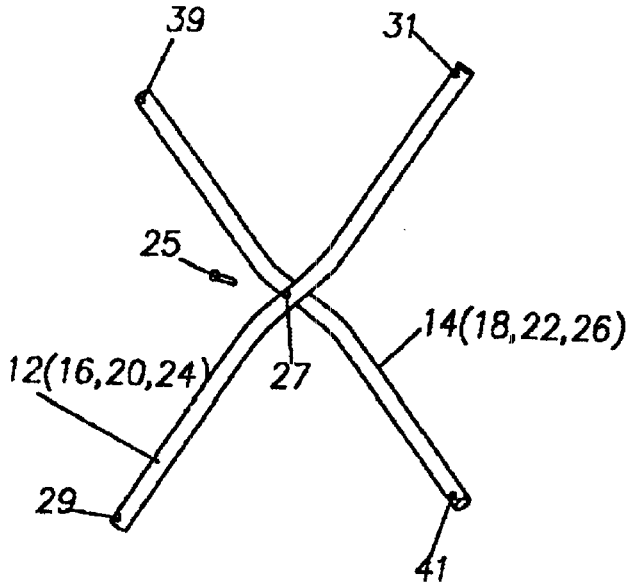
FIG. 17 pictorially illustrates a manner for securing the "X" shaped tubing legs together.
Figure 16A:
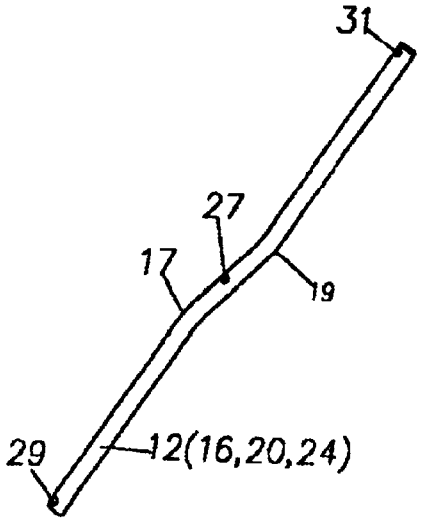
FIGS. 16A and 16B pictorially illustrate two of the eight "X" shaped tubing legs of the reclining beach chair with the bends which allow for bringing its seat near to the ground; while allowing the chair to be eventually collapsed compactly.
Figure 16B:
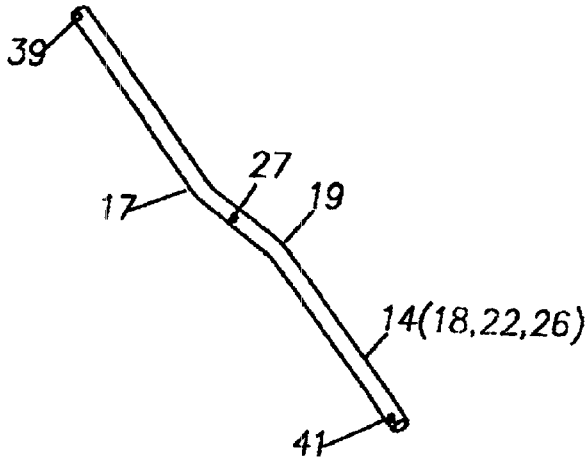

As illustrated in FIGS. 16A & 16B, the cross leg members 12 (also 16, 20, 24) and 14 (also 18, 22, 26) are fabricated with a pair of opposing "bends" at 17, 19 rather than being of "straight" length as are the legs of U.S. Pat. No. 5,984,406. An aperture 27 is provided mid-way between the bends 17, 19 to receive the pivot pin 25 (FIG. 17). Additional apertures 29, 31, 39 and 41 receive rivets or similar such fasteners in coupling the crossed legs 12 & 14, 16 & 18, 20 & 22 and 24 & 26 to the various connectors 35, 40, 45, 55 and 60 of FIG. 1.

Figure 7A:
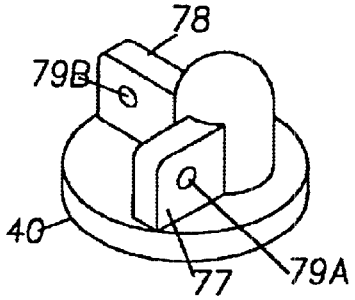

In particular, the lower end 101 of the crossed legs 12 & 14 are fastened by rivet or other appropriate manner to the front wall 77 of the front pad connector 40 shown as having a perpendicular side wall 78 (FIG. 7A), the fastener passing through its aperture 79A. Similarly, the lower end 102 of the crossed legs 22 & 24 also are riveted, or otherwise fastened, to the perpendicular wall 78, by means of its aperture 79B. As illustrated, both front pad connectors 40 are identical, with one of the lower ends 101 being on one side of the front wall 77, the other lower end being on the opposite side, and with the two lower ends 102 being on opposing faces of the side wall 78.

Figure 9A:
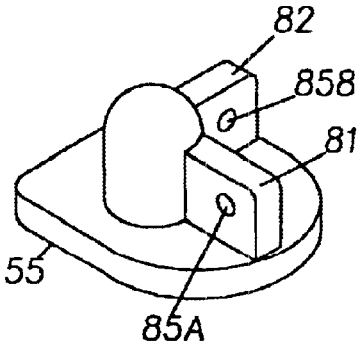
Figure 9B:
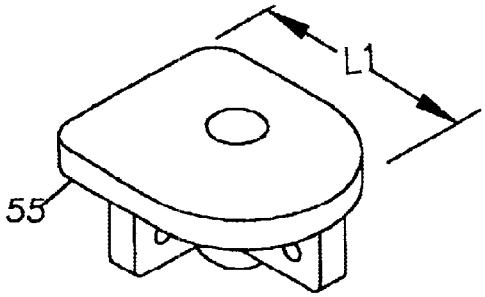
Figure 10A:
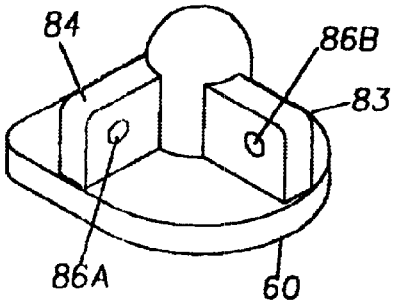
Figure 10B:
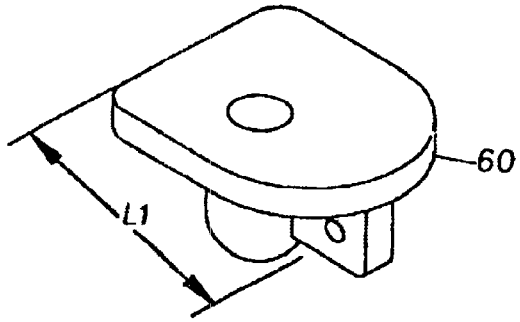
Figure 11A:
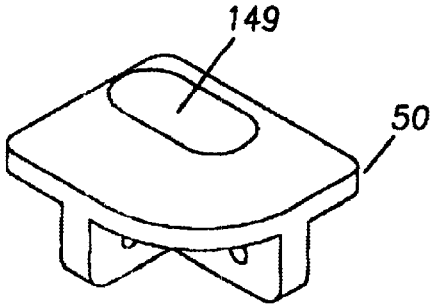
Figure 11B:
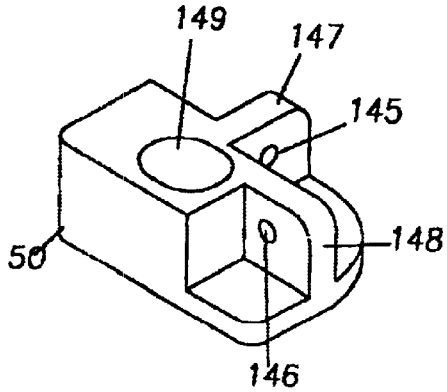
Figure 12A:
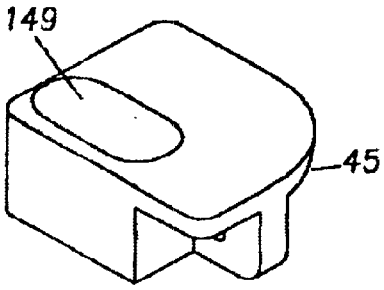
Figure 12B:
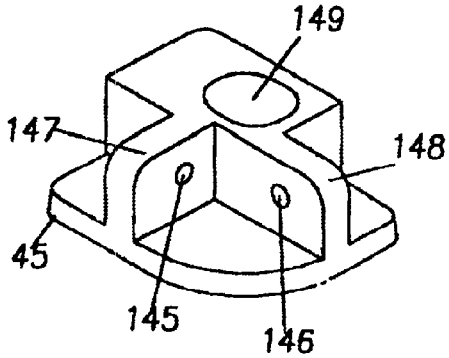

In like manner, the lower end 103 of the crossed legs 18 & 20 and the lower end 104 of the crossed legs 16 & 26 are fastened by rivets, or otherwise, to the rear pad connectors 55, 60 respectively, with the rear pad connector 55 being shown in FIGS. 9A & 9B, and with the rear pad connector 60 being shown in FIGS. 10A & 10B. Each of the connectors 55, 60 similarly include a pair of perpendicular walls 81, 82 and 83, 84, each with their own apertures 85A & 85B and 86A & 86B. As indicated, the lower end 103 of leg 20 is fastened to one side of the wall 81 via aperture 85A while the lower end 103 of leg 18 is fastened to one side of the wall 82 via aperture 85B. Correspondingly, the lower end 104 of leg 26 is fastened to the opposing surface of wall 83 of connector 60 via aperture 86B, while the lower end 104 of leg 16 is fastened to the opposing surface of wall 84 via aperture 86A.

Figure 7B:
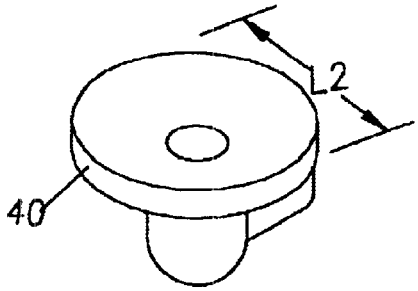
Figure 8A:
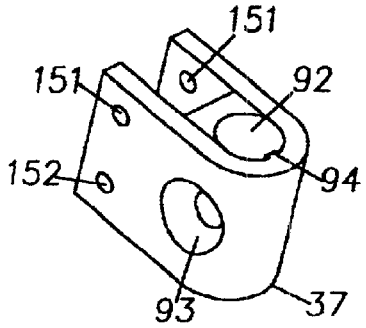
Figure 8B:
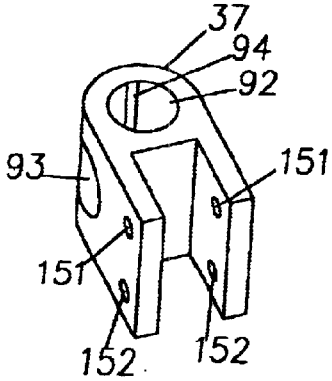

In accordance with the teachings of this reclining beach chair or lounger Application, the dimension $L_1$ (FIGS. 9B & 10B) between the front and rear surfaces of the connectors 55 and 60 is greater than the dimension $L_2$ (FIG. 7B) between the front and rear surfaces of the connector 40 (a diameter in the embodiment of FIGS. 7A & 7B) so as to effectively move the center of gravity of the frame 10 forward. This provides a greater stability to the reclining beach chair, a safety feature. Also to enhance stability and safety, a plurality of spaced, compressible pins 91 are included along the lower portion of legs 20 and 26 for fitting within the sliding lock mechanism 37 (FIGS. 8A and 8B). An aperture 92 in mechanism 37 receives the lower portion of the leg, with a second aperture 93 available to accept and capture the pin 91 by snap action to form a positive locking securement. A tab 94, of any desired cross-section, runs along the length of aperture 92 from front to back so as to slide within a linear groove 95 cut along the lower portion of legs 20 and 26 to secure and lock legs 20, 26 against sideways rotation—with the legs fabricated of extruded aluminum, which can be formed with the linear groove 95 as part of the extrusion. As will be appreciated, it is not generally an easy matter to make steel tubing with the groove 95 as required.

The upper end 111 of leg 20 and the upper end 113 of leg 14 are fastened together in front connector 35 in manner identical to the fastening in connector 32 of upper end 115 of leg 12 and upper end 117 of leg 26. The connectors 35 are illustrated in FIGS. 6A & 6B with one of the legs (20 or 12) being fastened through the apertures 121A and 121B of two parallel walls 122, 123, and with the other of the legs (14 or 26) being fastened through the aperture 124 of the perpendicular wall 125. The aperture 126 will be understood as receiving a screw or like fastener extending upwardly through the connector 35 to join with a cap 130 which holds the fabric liner 131 of the chair in place along the front of the seat (FIG. 5).

The upper end 141 of the leg 22 is similarly coupled with the upper end 142 of leg 16 within the connector 45, designed as a mirror image of the connector 50 which receives the upper end 143 of leg 18 and the upper end 144 of leg 24. These connectors 45 and 50 are illustrated in FIGS. 12A & 12B and 11A & 11B, respectively, with one leg fastened through each aperture 145, 146 of the perpendicular walls 147, 148, and with the aperture 149 corresponding to the aperture 33 in the connectors 45 and 50 of FIG. 1.

As illustrated in FIG. 1, to complete the basic frame 10 of the reclining beach chair or lounger, the side supports 28 and 30 pass through the aperture 33 in the connectors 45 and 50 to fasten by rivets or otherwise to the slide locking mechanism 37, and more particularly between the apertures 151—151 or 152—152 —as illustrated in FIGS. 8A & 8B.

Figure 5:
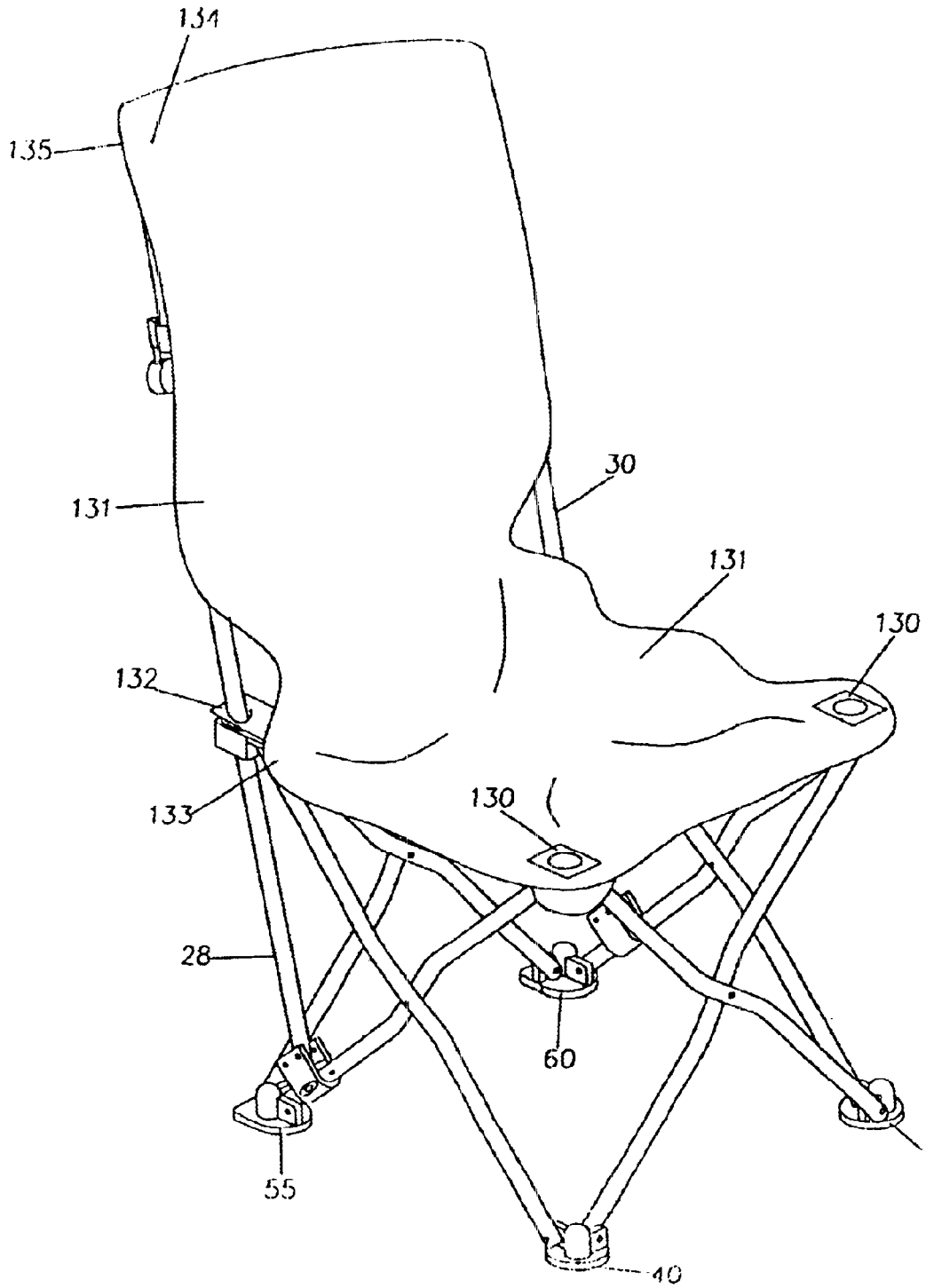
FIG. 5 is a front perspective view of the collapsible reclining beach chair or lounger in its unfolded position, with the seating fabric in place.
Figure 6A:
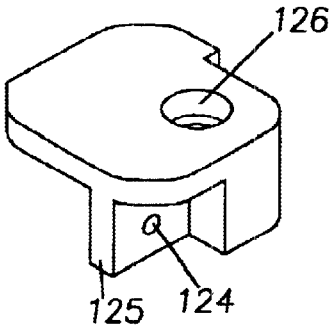
FIGS. 6A & 6B, 7A & 7B, 8A & 8B, 9A & 9B, 10A & 10B, 11A & 11B, 12A & 12B, and 13A & 13B are top and bottom perspective views respectively of various component parts of the beach chair of such invention, which allow the chair to be opened, low to the ground when in use, and to be collapsed for storing away (in a duffletype bag, for example) once the chair is fully collapsed.
Figure 6B:
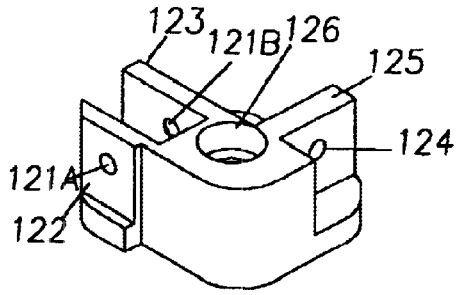

FIG. 5 illustrates the manner of attaching the fabric liner 131 to the chair frame 10. As previously mentioned, a cap 130 secures the front of the liner to the front of the frame. A strap 132 is sewn at left and right undersides 133 of the fabric liner 131, and is provided with an opening defined by a grommet (not shown), through which the side supports 28, 30 pass. A sleeve 134 is included at the rear underside of the fabric liner 131, to slip over the top 135 of the side supports 28, 30, reinforced in any desired manner. As shown, the strap 132 rests atop the rear connectors 45, 50.

With the frame 10 incorporating a pair of bends 17, 19 spaced about the pivot point 27, the seat level of the chair can be brought lower to the ground, to as low as six inches above it, as many users at a beach or seashore location (or just even on a backyard deck, or on the grass) prefer. By providing a slide locking mechanism 37 along the legs 20 and 26, the beach chair or lounger can be reclined to the desired angle, and with the snap provided through the multiple push pin positions with its capturing aperture 93, a secure lock at the desired position results. By making the rear pad connectors 55, 60 longer than the front pad connectors 40, further increased stability follows. With the position locking arrangements typifying the prior art, freeways rotational turning of the frame was experienced because of the "roundness" of the tubing employed in the lock—a possibility which is virtually eliminated through the scoring of the cross legs 20 and 26 at the groove 95, in receiving the tab 94 of the snap lock 37. In a preferred construction, the bends 17, 19 extend on either side of the pivot pins 25 a distance of 2 to 4 inches, depending upon how low to the ground the seat level of the frame 10 is to go. At the same time, the position to which the recline is set is adjustable either before or after the chair is opened.

Figure 13A:
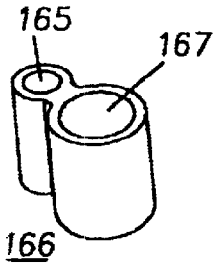
Figure 13B:
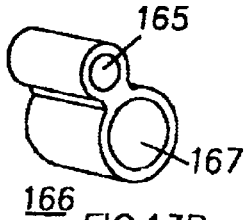
Figure 14A:
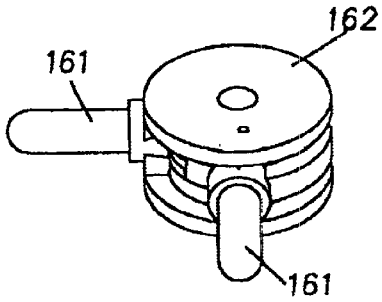
FIGS. 14A & 14B and 15A & 15B are top perspective views of components helpful in an understanding of the operation of the optional stabilizer bar of such reclining beach chair or lounger invention.
Figure 14B:
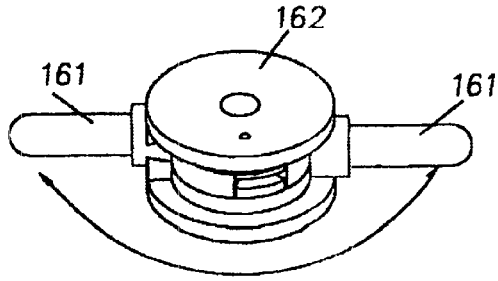
Figure 15A:
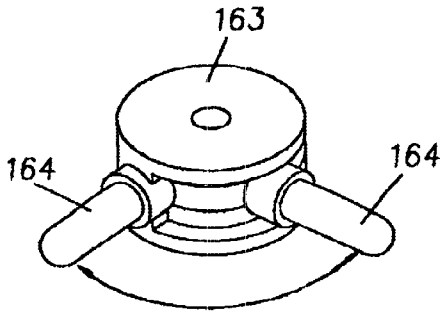
Figure 15B:
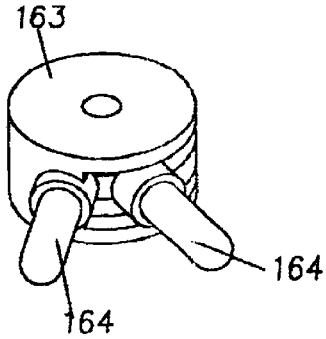

While the reclining beach chair or lounger as so far described performs quite well, a further feature of the design offers even greater stability in windy conditions, through the use of a bar 160 hinged between the supports 28, 30. Shown in FIG. 1, such bar 160 may be of a 2-piece tubular fabrication, fitted at one end "A" onto a rotatable extension 161 of a roller hinge 162 (FIGS. 14A & 14B showing the limits of rotation). At the opposite end "B" of the bar fabrication, a hinged bracket 163 is provided with its own rotatable extension 164 to fit within the tubular length (FIGS. 15A & 15B illustrating the rotational limits of this hinge). As shown in FIGS. 1, 13A and 13B, one rotatable extension 164 on each hinge 163 fits within an opening 165 in a coupler 166, a second opening 167 of which goes over the upper end 171 of the side supports 28, 30, where it is held by a press fit. When fabricating the bar 160 of aluminum or other stiffening material, not only is back support provided for the fabric of the chair, but stability of the side supports 28, 30 is present against ensuing wind.

FIG. 3 illustrates the first step in collapsing the reclining beach chair after use, where the stabilizer bar 160 is employed. Namely, the roller hinge 162 is lifted upwardly, as shown by the arrow 200, which exerts a pressure on the side supports 28, 30, in the direction of the arrows 201 pulling the supports toward each other. The motion rotates the locking mechanisms and the various legs and connectors inwardly, to take on the compact configuration of FIG. 4. Such action raises the rear connectors 45 and 50, to lift the fabric liner 131 which rests thereon, to collapse it as well, wherein the beach chair or lounger, then in a collapsed condition, can be placed in a duffle bag and carried about, or otherwise stored. Where the stabilizer bar 160 is not employed, only a gentle pressure on the supports 28, 30 in the direction of the arrows 201 is all that is necessary to begin the collapsing action.

As my application Ser. No. 09/551,664, U.S. Pat. No. 6,179,374 describes, whereas compressible pins 91 are set out to snap the slide lock mechanism 37 in secured position, other manners of fastening the mechanism in place can be utilized instead—such as by a lever and actuating spring into the extruded tubing.

B. Ser. No. 09/561,339, U.S. Pat. No. 6,322,138, Collapsible Patio Chair

As with the folding chair of U.S. Pat. No. 5,984,406, the collapsible patio chair of the application Ser. No. 09/561,339, U.S. Pat. No. 6,322,138 invention is also constructed out of tubular members. In FIG. 18, the frame of the patio chair 210 includes eight crossed legs in pairs of two each—front legs 212, 214, rear legs 216, 218, and side legs 220, 222 and 224, 226. As illustrated, each of the pairs 212 & 214, 216 & 218, 220 & 222 and 224 & 226 are joined together by pivot pins 225. The frame 210, furthermore, includes a pair of side supports 228, 230—which, like the crossed legs 212 & 214, 216 & 218, 220 & 222 and 224 & 226 are tubular, and are constructed of aluminum or steel.

A pair of front connectors 235 join the crossed legs 214 & 220 and 212 & 226 together at their upper ends. A pair of front pad connectors 240 join the crossed legs 212 & 222 together, as well as the crossed legs 214 & 224, at their bottom ends. Similarly, two rear connectors 245, 250 respectively connect the upper ends of crossed legs 216 & 222 and 218 & 224 at their upper ends. Two rear pad connectors 255, 260 respectively join the lower ends of the crossed legs 218 & 220 and 216 & 226. As shown in FIGS. 18–20, the side supports 228, 230 respectively extend downwardly through apertures 233, in the rear connectors 245, 250, to fix with the rear pad connectors 255 and 260 without pivoting. With the patio chair constructed with hand rests, each front leg 212, 214 is provided with an extension 265 that extends upwardly through the front connectors 235 and bends outwardly to form a front support 266 where it is secured, as by a screw, with a sleeve at a front underside of a fabric hand rest (215, in FIG. 21), at the rear of which a grommet 267 on the fabric encircles the side supports 228, 230, and where it is restricted in upwards movement by a ring 268 on the supports 228, 230. As with the hand rests of U.S. Pat. No. 5,984,406, the hand rest 215 provides a support for the user's arm, as well as a manner to fold and unfold the chair with adequate leverage.

Particularly referring to FIGS. 18, 19, 24A & 24B, and 25A & 25B, the lower end 301 of the crossed legs 212 & 214 are fastened by rivet or other pivot manner to the front wall 284 of the front pad connector 240 shown as having a generally perpendicular side wall 283, the fastener passing through its aperture 286A. Similarly, the lower end 302 of the crossed legs 222 & 224 is also fastened by rivet, or other pivot to the wall 283, by means of its aperture 286B. As illustrated, both front pad connectors 240 are identical, with one of the lower ends 301 being pivoted on one surface of the front wall 284, with the other one of the lower ends 301 being on the opposite surface of the front wall 284, and with the two lower ends 302 being pivoted on opposing faces of the side wall 283.

In like manner, the lower end 303 of the crossed legs 218 & 220 and the lower end 304 of the crossed legs 216 & 226 are fastened by rivets, or other pivots to the rear pad connectors 255, 260 respectively, with the rear pad connector 255 being of the configuration shown in FIGS. 25A & 25B, and with the rear pad connector 260 being of the configuration shown in FIGS. 25A & 25B rotated 90 counterclockwise. Each of the connectors 255, 260 thus include their own pairs of generally perpendicular walls and their own apertures. As indicated, the lower end 303 of leg 220 is fastened by pivot or otherwise to rear pad connector 255 at one surface of the wall 284 via aperture 286A while the lower end 303 of leg 218 is fastened by pivot or otherwise to one surface of the wall 283 via aperture 286B. Correspondingly, the lower end 304 of leg 226 is fastened to the opposing surface of wall 284 of connector 260 via aperture 286A, while the lower end 304 of leg 216 is fastened to the opposing surface of wall 283 via aperture 286B. In accordance with the invention, apertures 287 are included at the joins 288 of the walls 283, 284 of the connectors 255, 260 to receive the lower ends of the side supports 228, 230, where they are fixed by rivets or otherwise, without pivoting. Although not receiving side supports, the front pad connectors 240 may be constructed with a similar aperture 287 at the joins 288 of their walls 283, 284, to allow for a common construction of these front and rear pad connectors and an interchangeability of components, although such apertures 287 at the front pad connectors are not needed for operation of the collapsible patio chair.

The upper end 311 of leg 220 and the upper end 313 of leg 214 are fastened together in front connector 235 in manner identical to the fastening in connector 35 of upper end 315 of leg 212 and upper end 317 of leg 226. The connectors 235 are illustrated in FIGS. 22A & 22B and 23A & 23B—with the configurations of FIGS. 22A & 22B receiving the legs 212 and 226, and with the configuration of FIGS. 23A and 23B receiving the legs 214 and 220. As shown, the connectors 235 include a top surface 290 having a notch therein 291 open at one end, understood to be slightly larger than the diameter of the crossed legs 212, 214 when composed as a tubular configuration. This dimensioning allows the legs 212, 214 to glide easily within the notch 291 as the patio chair is folded closed or opened. As more particularly shown in FIGS. 22B and 23B, the front connectors 235 further include a first wall 292 at an underside defining one side of the notch 291 and to which the legs 214 and 212 are fastened. At the same time, the connectors 235 include a second wall 293 at the underside, generally perpendicular to the wall 292 in combination therewith, to which the upper ends 311 and 317 of the crossed legs 220 and 226 are fastened. In similar manner, both perpendicular walls 292, 293 are provided with apertures 295, 296 for fastening with their respective pivotally connected legs.

The upper end 341 of the leg 222 is similarly coupled with the upper end 342 of leg 216 within the connector 245, designed as a mirror image of the connector 250 which receives the upper end 343 of leg 218 and the upper end 344 of leg 224. These connectors 245 and 250 are illustrated in FIGS. 26A & 26B and 27A & 27B respectively, with one leg fastened through each aperture 345 and 346 of the perpendicular walls 347 and 348 as shown, and with the aperture 349 corresponding to the aperture 233 in the connectors 245 and 250 of FIG. 18 through which the side supports 228, 230 pass.

FIG. 21 illustrates the manner of attaching the fabric liner 331 to the chair frame 210. A sleeve at an underside of the liner front 332 is pulled down once installed at A to fit over the front connectors 235. A strap 333 is sewn at left and right undersides 334 of the fabric liner 331, and is provided with an opening defined by a grommet 335 through which the side supports 228, 230 pass. As shown, the strap 333 rests atop the rear connectors 245, 250, and its upward movement is restricted by a second ring 269 on the side supports 228, 230. Sleeves are also included at the rear underside of the fabric liner 331, adjacent its top, to slip over the top 336 of the supports 228, 230 (where they are secured as by a screw), with all areas of connection of the fabric liner being reinforced in any desired manner.

To collapse the opened chair of FIG. 18, all that is needed is for one to grasp onto the upper bends 265 of the legs 212, 214, and push them towards one another. The legs 212, 214 readily slide within the notch 291, and the pivot connections of all the legs to opposing faces of the perpendicular walls reliably collapses the frame 210 to the compact configuration of FIG. 20. Then, in a collapsed condition, the patio chair can be placed in a duffle bag and carried out, or otherwise stored. As will be appreciated, the collapsing of the chair to the configuration of FIG. 20 will be understood to fold the fabric hand rest 215 upwardly and out of the way at the same time.

C. Ser. No. 09/593,938, U.S. Pat. No. 6,364,410, Collapsible Cot

As with the folding chair of U.S. Pat. No. 5,984,406, the collapsible cot of the application Ser. No. 09/593,938, U.S. Pat. No. 6,364,410 invention is further constructed out of tubular members. In FIG. 28, the frame of the cot 410 includes a first pair of front crossed legs 412, 414, a second pair of front crossed legs 416, 418, a first pair of rear crossed legs 420, 422, a second pair of rear crossed legs 424, 426, a first pair of side crossed legs 428, 430, a second pair of side crossed legs 432, 434, and a third pair of side crossed legs 436, 438. As illustrated, each of the pairs 412 & 414, 416 & 418, 420 & 422, 424 & 426, 428 & 430, 432 & 434, and 436 & 438 are joined together by pivot pins 425.

A first front pad connector 440 pivotally connects to lower ends of the front crossed leg 412 and the side crossed leg 428, while a second front pad connector 442 pivotally connects to lower ends of the front crossed leg 418 and the side crossed leg 432. A first rear pad connector 444 pivotally connects to the lower ends of the rear crossed leg 420 and the side crossed leg 430, while a second rear pad connector 446 pivotally connects to lower ends of the rear crossed leg 426 and the side crossed leg 434. A first front connector 448 pivotally connects to the upper ends of the front crossed leg 414 and the side crossed leg 430 while a second front connector 450 pivotally connects at an upper length of the front crossed leg 416 and to the upper end of the side crossed leg 434. A first rear connector 452 pivotally connects to the upper ends of the rear crossed leg 422 and the side crossed leg 428, while a second rear connector 454 pivotally connects at an upper length of the rear crossed leg 424 and to the upper end of the side crossed leg 432.

In accordance with the construction of the collapsible cot, a third front pad connector 456 is included, pivotally connected to the lower ends of the front crossed legs 414 & 416 and to the lower end of the side crossed leg 436. A third rear pad connector 458 similarly is pivotally connected to the lower ends of the rear crossed legs 422 & 424, and to the lower end of the side crossed leg 438. A third front connector 460 pivotally connects to upper ends of the front crossed legs 412 & 418, and to the upper end of the side crossed leg 438. A third rear connector 462 then pivotally connects to the upper ends of the rear crossed legs 420 & 426, and to the upper end of the side is crossed leg 436.

To complete the configuration of the frame 410, a first side extender 470 pivotally couples to the front crossed leg 416 along its upper length, while a second side extender 472 pivotally couples to the rear crossed leg 424 along its respective own upper length.

As illustrated in FIG. 37, a fabric liner 500 is connected to the front connectors 448 and 460 and to the rear connectors 452 and 462 and to fit over and around the upper ends A, B, of the side extenders 470, 472—both for this construction of the cot and for a second construction to be described below.

In FIG. 28, the side extenders 470, 472 are shown pivotally coupled to the front crossed leg 416 and to the rear crossed leg 424 at a point above the second front connector 450 and the second rear connector 454, respectively. FIGS. 29A–29F illustrate the pivotal coupling of the two side extenders 470, 472 to their respective front and rear crossed legs 416, 424 by means of a hinge pin 490, 492, for example, in the manner noted in FIGS. 29A–29C, and rotatable from its open position of FIG. 29D through its immediate position shown in FIG. 29E to its folded position of FIG. 29F, when it is desired to collapse the frame 410 of the cot. The end of the extenders 470, 472 to which the fabric liner 500 secures when in place is again indicated at A, B. FIGS. 38A–38C in this respect illustrate sectional views of a manner of securing the fabric liner 500 to the front connectors 448, 460 and to the rear connectors 452, 462, by means of a bolt 501, for example, extending through apertures 575 in the liner 500 overlying each of the four connectors at such point, to seat within a cap 502 which fits substantially flat there against the top surface of the liner 500.

FIG. 35, on the other hand, shows an alternative construction in which the side extenders 470, 472 are each pivotally coupled to the front crossed leg 416 and to the rear crossed leg 424 at a point below the second front connector 450 and below the second rear connector 454, respectively, instead of above those connectors as in FIG. 28. As shown in FIGS. 36A and 36B, the construction of FIG. 35 is one in which a first bracket 484 is included at a point below the second front connector 450 while a similar second bracket 486 is included at a point below the second rear connector 454. As illustrated more particularly in FIG. 36B, the two side extenders (470 on the one hand, and 472 on the other), are pivotally coupled to the brackets 484, 486, by a pin 435 to permit the pivoting of the side extenders 470, 472, about both the front crossed leg 416 and the rear crossed leg 424. Each of the brackets 484, 486 typically may be composed of steel, welded to the crossed leg 416 (or 424 as the case may be), to receive and join with the respective extender 470, 472. As FIGS. 36A and 36B further show, a first tap 480 is provided along the upper length of the front crossed leg 416 while a second such tap 482 is provided along the upper length of the rear crossed leg 424, to allow for positioning of the side extenders 470 and 472, respectively, in fixing the position of the side extender with its respective crossed leg.

FIG. 36B further shows a fastener 488 at left and right undersides of the fabric 500, near its top end, at a position to overlie the side extender and its adjacent crossed leg, for securing the respective extender and leg together. Thus, those points labelled C and D in FIG. 35 illustrate the locations where the fasteners 488 of the fabric 500 secure in holding the side extender 470 to the crossed leg 416 and the side extender 472 to the crossed leg 424—with the fastener 488 being in the form of a steel ring when the crossed legs 416, 424 and the side extenders 470, 472 are tubular. FIG. 37, in this respect, shows this alternative construction with the fabric liner 500.

Particularly referring to FIGS. 28, 35, 37, 30A & 30B, the lower end of the front crossed legs 412 & 418 are fastened by rivet or other pivot manner to the front wall 510 of the front pad connectors 440, 442, shown as having a generally perpendicular side wall 512, the fastener passing through its aperture 514. Similarly, the lower end of the side crossed legs 428 & 432 is also fastened by rivet or other pivot to the wall 512 by means of its aperture 516. As illustrated, both front pad connectors 440, 442 are identical, with the lower end of the front crossed leg 412 being pivoted on one surface of the front wall 510 on one connector 440, 442, with the lower end of the front crossed leg 18 being on the opposite surface of the front wall 510 of the other connector 440, 442, and with the lower ends of the side crossed legs 428 and 432 being pivoted on opposing faces of the side wall 512.

In like manner, referring to FIGS. 28, 35, 37, 32A & 32B, the lower end of the rear crossed legs 420 & 426 and the lower ends of the side crossed legs 430 & 434 are fastened by rivets or other pivots to the rear pad connectors 444, 446. Each of the connectors 444, 446 include their own pairs of generally perpendicular walls and their own apertures. Thus, and as indicated, the lower end of the front crossed leg 420 is fastened by pivot or otherwise to rear pad connector 444 at one surface of the wall 511 by aperture 515 while the lower end of leg 426 is fastened by pivot or otherwise to one surface of the wall 513 by aperture 517. Correspondingly, the lower end of the side crossed leg 430 is fastened to the opposing surface of wall 511 via aperture 515 while the lower end of the side crossed leg 434 is fastened to the opposing surface of wall 513 via aperture 517. In accordance with the construction, an aperture 518 is included at the joins of the walls 511 & 513 of the connectors 444, 446 to receive the lower end of the rear supports 464, 466, where they are fixed by rivets or otherwise, without pivoting. Although not receiving any supports, the front pad connectors 440, 442 may be constructed with a similar aperture 519 at the join of their walls 510 & 512, to allow for a common construction of these front and rear pad connectors and an interchangeability of components, although such apertures 519 at the front pad connectors 440, 442 are not needed for the operation of the collapsible cot.

As an examination of FIGS. 28 and 37 will show, the front connector 448 may be constructed identical to the rear connector 452, except insofar as the rear connector 452 includes an aperture to receive the upper end of the rear support 464—with the remaining structure of these two connectors continuing to have generally perpendicular side walls to which the upper ends of the front crossed leg 414 and the side crossed leg 430 are pivoted on the one hand with respect to the front connector 448, and to which the upper ends of the rear crossed leg 422 and the side crossed leg 428 are likewise pivotally connected with respect to the rear connector 452 on the other hand, This is shown in FIGS. 34A & 34B where the perpendicular side walls are shown at 547, 548, and where the aperture for the support 464 is shown at 549. The pivot connections for the legs are through the apertures 545, 546.

The third front pad connector 456 is similarly constructed comparable to the third front connector 460 in having yet a further perpendicular wall so as to receive three sets of legs instead of the two sets as with the front pad connectors 440 and 442—pivotally receiving the lower ends of the front crossed legs 414 & 416 and the lower end of the side crossed leg 436. Correspondingly, the third front connector 460 receives at its three perpendicular walls, the pivot connections of the front crossed legs 412 & 418 and the upper end of the side crossed leg 438. The third rear connector 462, on the other hand, includes the same three perpendicular walls to receive, in pivot connections, the upper ends of the rear crossed legs 420 & 426 and the side crossed leg 436—although with a further aperture to receive the rear support 468 extending up from the rear pad connector 458. In such manner, the rear pad connector 458 and the rear connector 462 may be mirror images of one another, just as are the front pad connector 456 and the front connector 460. As will be appreciated, each of the connectors 448, 452, 460 and 462 are provided with apertures 475 as indicated in FIGS. 28 and 35 to receive the bolt 501 and cap 502 of FIGS. 38A, 38B & 38C in holding the fabric liner 500 in place.

To complete the constructions of the collapsible cot, the upper end of the side crossed leg 432, is fastened along the upper length of the rear crossed leg 424 on the rear connector 454 in a manner identical to that by which the upper end of the side crossed leg 434 is fastened along the upper length of the front crossed leg 416 in the front connector 450. Such connectors 450 and 454 are illustrated in FIGS. 31A & 31B and 33A & 33B, respectively—with the configurations of FIGS. 31A and 31B receiving the legs 416 and 434, and with the configurations of FIGS. 33A & 33B receiving the legs 424 and 432. As shown, the connectors 450, 454 include a top surface 550 having a notch therein 551 open at one end, understood to be slightly larger than the diameter of the crossed legs 416, 424 when composed as a tubular configuration. This dimensioning allows the legs 416, 424 to glide easily within the notch 551 as the cot is folded closed or opened. As more particularly shown in FIGS. 31B and 33B, the front connector 450 and the rear connector 454 further include a first wall 552 at an underside defining one side of the notch 551 and to which the legs 416 and 424 are fastened. At the same time, the connectors 450 and 454 include a second wall 553 at the underside, generally perpendicular to the wall 552 in combination therewith, to which the upper ends of the side crossed legs 434 and 432 are fastened. In similar manner, both perpendicular walls 552 and 553 are provided with apertures 554, 555 for fastening with their respective pivotally connected legs.

To collapse the opened cot of FIGS. 28 and 35, all that is needed is for one to push forward the side extenders 470, 472, to the upper ends of the front crossed leg 416 and the rear crossed leg 424. The legs 416, 424 readily slide within the notch 551, and the pivot connections of all the legs to opposing faces of the perpendicular walls reliably collapses the frame to a compact configuration. Then, in a collapsed condition, the cot can be simply carried to wherever it may be placed for storage. As will be appreciated, the collapsing of the cot will be understood to fold the fabric liner 500 inwardly and out of the way at the same time,yet without it having to be removed from the side extenders 470, 472.

D. Collapsible Constructions of the Present Invention

As was previously mentioned, a particularly attractive type of casual seating can be had for the collapsible reclining beach chair or lounger through the addition of an arm rest and/or a foot rest. By having such rests being collapsible—and by complementing them with pillows and with cooler/utility bags and cup holders which also fold when collapsed with either the lounger, the patio chair, or the cot of my earlier inventions—several constructions result which are quite useful for these types of casual seatings.

1. Collapsible Pillow

With this aspect of the present invention—illustrated in FIG. 39, for example, with the collapsible reclining beach chair or lounger of my Ser. No. 09/551,664, Patent No. invention—a pillow 600 hangs over the fabric liner 131 on the front of the lounger when the chair is open, and fits between its side supports 28, 30, when the lounger is collapsed (FIG. 40). As will be appreciated, this becomes possible from the presence of an "empty slot" area 605 in the chair when the lounger is collapsed (FIG. 4).

Figure 4:
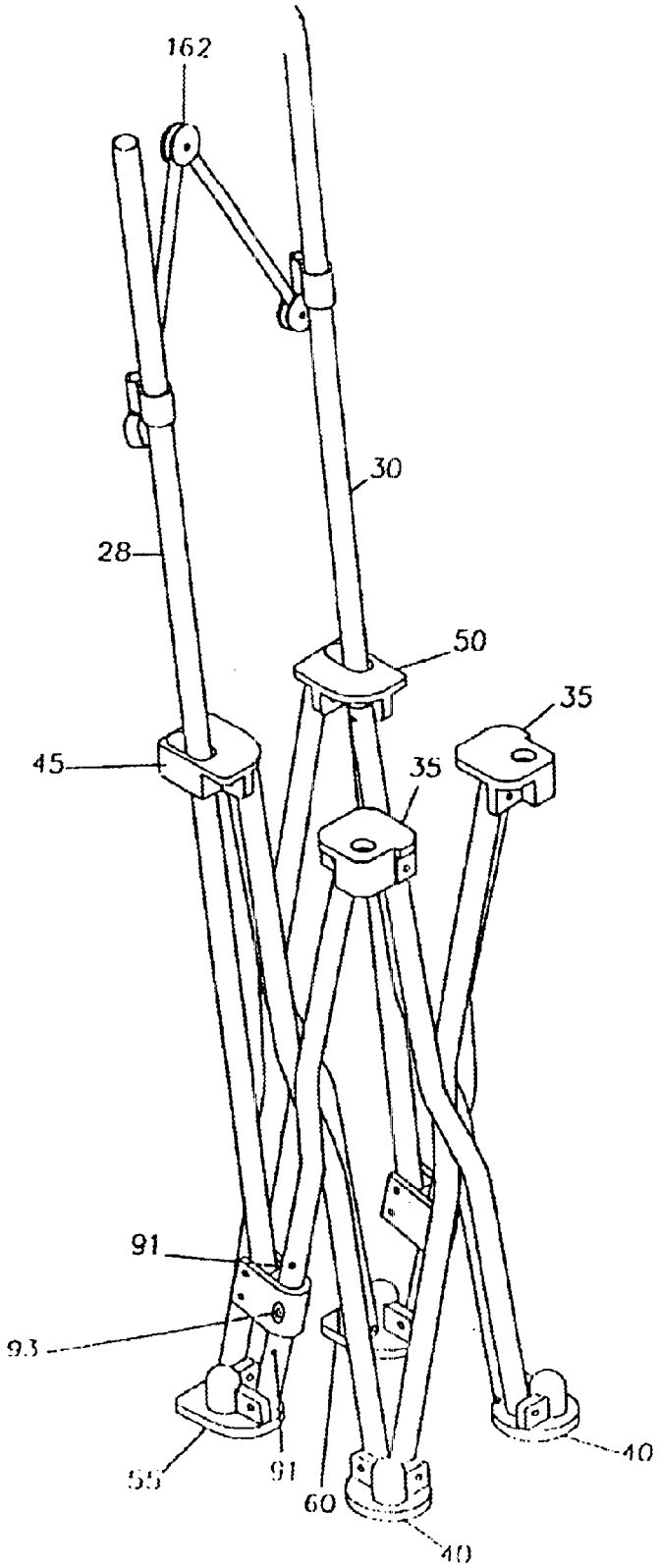
FIG. 4 is a front perspective view of the beach chair when fully collapsed, ready for storage.

To take advantage of such "empty slot" in FIG. 4, a first attaching strip 601 is sewn between, or similarly connects as by a "snap-button", the pillow 600 with the back of the liner 131, while a second attaching strip 602 is detachably coupled between the pillow 600 and the back of the liner. This allows the pillow 600 to be flipped from the horizontal position shown in FIG. 39 when in place, to a vertical position within the slot 605 as the reclining lounger is folded. Once flipped to the vertical position, the strip 602 can be reattached about a side support of the lounger when fully collapsed, to then hold the pillow 600 in place once more. In this respect, the attaching strip 601 may be stitched between the pillow 600 and the liner 131, and the attaching strip 602 may be of a conventional hook-and-loop Velcro adhesive.

Figure 42A:
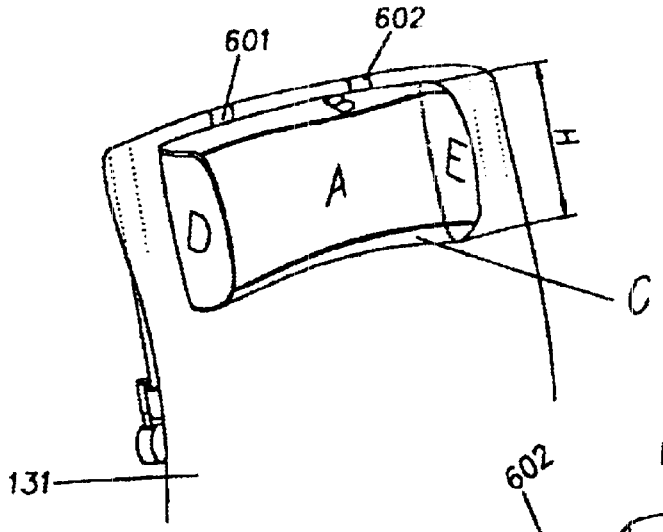
Figure 42B:
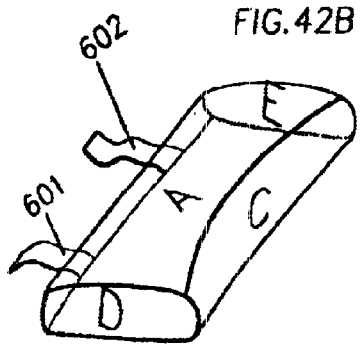
Figure 42C:
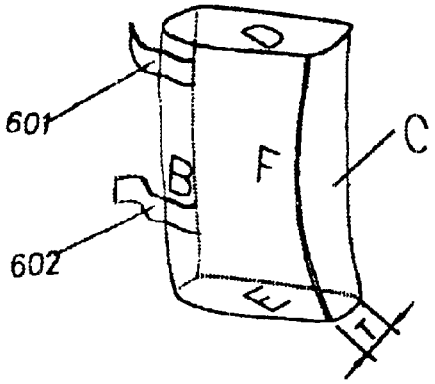

The various schematics of FIGS. 42A–42E will be helpful in understanding the flipping sequence of the pillow 600—with the understanding that the placements of the two strips 601, 602 can just as easily be reversed, side-to-side. FIG. 41A, however, first illustratively shows (in simplified form) the lounger when fully collapsed, and FIG. 41B illustratively shows the lounger in its opened, reclining position. As will be seen, the width W of the slot 605 when the lounger is collapsed (FIG. 40) may be equal to, slightly greater than, or slightly less than, the thickness T of the pillow 600 (FIG. 42C). Secondly, both attaching strips 601 and 602 may be connected at points equi-distant from the left and right side ends of the pillow 600, with the strip 601 being of sufficient length to permit its encirclement over and about the side support 30 (see FIG. 40), and with the length of the strip 602 being selected sufficiently long to enable its re-attachment about the side support 30 in securing the pillow 600 in position once the reclining lounger is collapsed.

Thus, FIG. 42A schematically shows the pillow 600 in horizontal position against the liner 131 for the open lounger, with front and rear surfaces A & F, with top and bottom surfaces B & C and with side surfaces D & E, although not drawn to scale. Uncoupling the Velcro strip 602 and rotating the pillow 600 90° upwardly leads to the position of the pillow schematically shown in FIG. 42B—such that surface A then faces upwardly. Rotating the pillow 600 counterclockwise 90° then, followed by rotating it upwardly 90° from the bottom, leads to the position of the pillow shown in FIG. 42C, in which the rear surface F faces forwardly and in which the side surface C faces to the right. Rotating the pillow 600 then a further 90 ° counterclockwise results in the position schematically shown in FIG. 42D, with the pillow 600 in a vertical plane, with the stitched attaching strip 601 at the top looped around the side support 30, and the detachable strip 602 at the bottom, ready to be connected about the support 30. The orientation of the pillow 600 is thus in accordance with the collapsed condition of the lounger shown in FIG. 40, and with the pillow 600 able to be fitted easily between the supports 28, 30 when of a thickness less than the distance between the two supports.

Figure 42D:
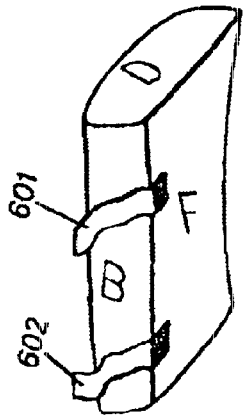

(It will be readily appreciated by those skilled in the art that the progression from the position of FIG. 42A to that of FIG. 42D may be attained through other sequences of rotation than as set forth above. It will also be appreciated that these connections follow an intention to employ as large a pillow as possible for user convenience. In those instances where a smaller dimensioned pillow is to be used, the strips 601, 602 which couple the pillow 600 to the rear of the fabric liner 131 could each be of a hook-loop Velcro adhesive, to be simply detached from the liner before or as the lounger is being collapsed, to be then simply stowed in the slot 605 which results. The attractiveness of such an alternative arrangement will be understood when one considers transshipment of the lounger from manufacturer to ultimate user, by which the smaller pillow could simply be packed in the empty slot 605 and held there in place during transportation. However, for the pillow to automatically fold as the recliner or lounger is collapsed, one of its attaching strips, according to the invention, first requires its detachability. Analysis will also show a similar requirement where the pillow is arranged for the patio chair or cot of my above-noted inventions.)

2. Collapsible Cooler/Utility Bags And Cup Holders

With this aspect of the present invention—illustrated in FIG. 43, (once again for example, with the collapsible reclining beach chair or lounger of my Ser. No. 09/551,664, U.S. Pat. No. 6,179,374 invention as shown in FIG. 5)—a cooler/utility bag 620 is shown, with a cup holder 622 for similar coupling to the fabric liner 131 on the front of the lounger when the chair is open. As will be seen from the description below, furthermore, like the pillow 600 of FIGS. 39–42, the cooler/utility bag 620 and the cup holder 622 are themselves foldable with the lounger as it is being collapsed. As will also be seen, as with the pillow, one of their attaching strips is non-detachable at one end to prevent its being lost—although, where desirable, the bag 620 holder 622 combination also can be fully detachable and stowed in the "empty slot" area 605 of the reclining lounger between the side supports 28, 30 during shipment. As with the pillow 600, one of the attachment strips is sewn to the fabric liner 131, or otherwise connected, although, here, the detachable hook-and-loop Velcro adhesive strip is replaced by a "hook" in the preferred embodiment. And, as FIG. 43 shows, the fabric liner 131 is modified to include a pair of preferably reinforced apertures 624, 626, the first of which (624) is located in the "seat" portion of the liner 131 while the second of which (626) is located in the "back" portion of the liner.

In particular, the cooler/utility bag 620—some 11" long, 5½" tall and 3" deep so as to be also used as a "book bag", for example—is provided with a first hook 628 (detail A, FIG. 44A), a second hook 630 (detail B, FIG. 44B) joined with the aperture 624 (detail C, FIG. 44C) and a permanent stitching 632 to the underside of the fabric liner 131 (detail D, FIG. 44D). As will be appreciated, with a conventional size for a 12 oz can of soda being 2-⅝" diameter and 5" height, the above dimensions for the cooler/utility bag 620 are sufficient for holding four of these beverage containers.

Figure 45A:
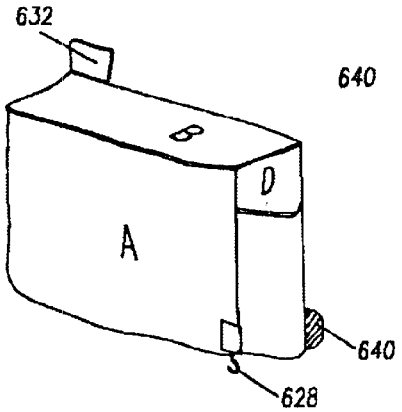
Figure 45C:
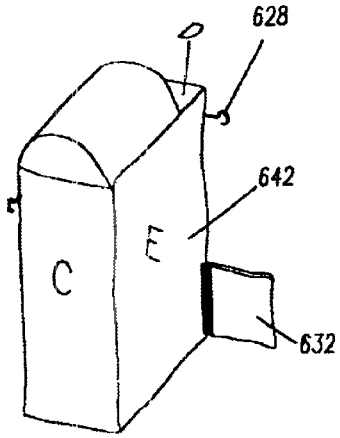
Figure 45B:
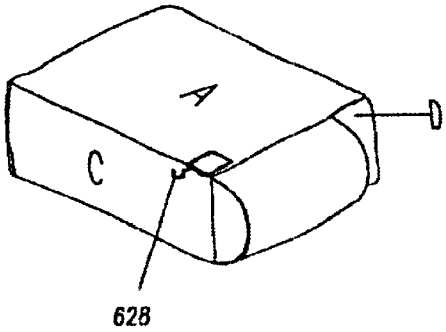
Figure 45D:
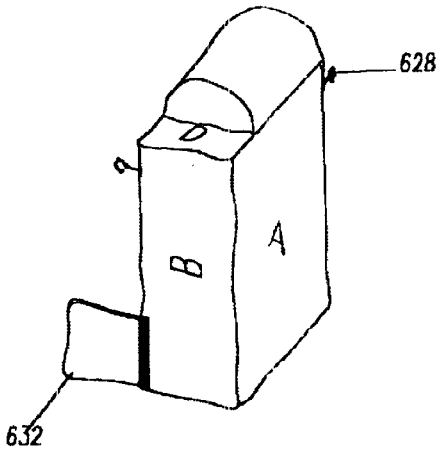

For the cooler/utility bag 620 to be stored within the same "empty slot" 605 of the lounger where the pillow of FIGS. 39–42 is fitted, for example, a comparable type of detachment, flipping and twisting procedure is necessitated. Thus, after detaching the hook 630 from the aperture 624, the cooler/utility bag 620 (with front and rear surfaces A & E, with top and bottom surfaces B & C and with right and left side surfaces D & F) is twisted and rotated as follows:

With the hook 630 released and with the permanent stitching 632 in position (FIG. 45A) the cooler/utility bag 620 is rotated upwardly 90° to the position shown in FIG. 45B, then rotated vertically and in a counterclockwise direction 90° to the position of FIG. 45C, then rotated horizontally 90° counterclockwise to result in the position of FIG. 45D. The second hook 628, then being positioned adjacent to the aperture 626 in the fabric liner 131 is inserted to present the overall appearance of FIG. 46.

As the weight of any, cans in the cooler/utility bag 620 or anything in the cup holder 622 would have a tendency to tilt the cooler/utility bag 620 inwardly towards the reclining chair, patio chair or cot in conjunction with which it is to be used, the rear surface of the bag 620 adjacent to its bottom, is provided with a bumper to rest against the side crossed members of the casual seat in "righting" the cooler/utility bag when so loaded. Such bumper is Vindicated as 640 in FIG. 45A. For storage, when the bag 620 is not in use, a typical Velcro strip 642 sewn at the rear surface of the bag (FIG. 45C) couples to a similar coupling strip 644 at an underside of the seat portion of the fabric liner 131, to be there held in position (FIG. 43). Freeing the two strips 642, 644 then rotates the bag 620 holder 622 combination to the position shown in FIG. 43. As will be appreciated, other types of fasteners could alternatively be employed, just as the hooks 624 and 628 could be substituted by other hook and loop adhesives, instead of through the use of the metal or plastic hook constructions envisioned. As with the pillow of FIGS. 39–42, the cooler/utility bag 620 (with or without the cup holder 622) is thus foldable into the casual seat frame as the lounger is being collapsed. A similar analysis will show that the exact same manner of coupling the cooler/utility bag with the fabric liner folds the bag into the empty slot created when the patio chair or cot of my earlier inventions are collapsed.

3. Collapsible Arm Rest

While FIGS. 18–26 illustrate a very attractive collapsible patio chair embodying my invention, the hand or arm rest shown as 215, in FIG. 21, is of a fixed length. This is the case with all reclining lounge chairs available in the prior art and generally detracts from their reliability of operation. In accordance with this invention, on the other hand, an adjustable length feature typifies the arm rest—such that when the reclining beach chair or lounger is set to its straight-up position, the arm rest will be at its shortest length—whereas, when the lounger is set to its most reclining position, the arm rest will then be at its longest length. Not only is this adjustable length arm rest quite reliable in operation, it has been found to be the most simplest and easiest to use.

In accomplishing this, the reclining beach chair or lounger of FIG. 1 is modified as respects its front connectors 35 so as to take on the appearance of the front connectors 235 of the collapsible patio chair configuration of FIG. 18. At the same time, the front legs 12 and 14 of the FIG. 1 lounger are modified to take on the appearance of the front legs 212 and 224 of the patio chair of FIG. 18 as respects the upper bends 265 of the legs 212, 214 in forming the front support 266 for the arm rest. This results in the general appearance of FIG. 47. As so far described then, FIG. 48 illustrates the reclining beach chair with the arm rests shown at 650, with the pillow shown at 600 and with the cooler/utility bag shown at 620. Reference numeral 622 continues to illustrate the cup holder employed with the cooler/utility bag 620, while the upper bends of the modified front legs 12, 14 continue to be shown at 265.

FIGS. 49 and 50 are views of the reclining lounger of FIG. 48 in its "straight-up" and most reclining position, respectively (but without the pillow 600, the cooler/utility bag 620 and the cup holder 622 for purpose of simplicity), while FIGS. 51, 52, 53 and 54 illustrate the adjustable length feature of the arm rest for each of these two positions. More specifically, FIGS. 51–54 show the arm rest 650 as consisting of two sections, one of which 652 includes an oval aperture 653 and a grommet 654 about the side support 28, 30 of the lounger, along with a series of spaced slots 655—illustrated as five in number, and preferably equally spaced in the embodiment depicted. At the rear end of the other section 657, a clasp in the form of a looped fastener 658 is embedded (FIG. 53), dimensioned to fit within one of the five slots 655. In the straight-up position of the reclining lounger of FIGURE.49, the looped fastener 658 is shown as seated within the far-most slot 655A, with the remainder of the front section 657 then lying over the unused slots 655 of the rear section 652, whereas in the most reclining position of FIG. 50, the fastener 658 fits within the near-most slot 655E. As will be appreciated, adjusting the fastener 658 into any one of the slots 655A–655E thereby adjusts the length of the arm rest 650, in conjunction with the recline afforded to the lounger shown. To facilitate reliability of operation, the aperture 653 is ovate rather than circular, to ease movement of the side support 28, 30 as the arm rest 650 is being adjusted. For the same reason, the arm rest section 652 is shown with a downwards angular tilt at its rear end in joining with the side support 28, 30 (FIG. 54).

(FIG. 55 illustrates yet a further way of adjusting the length of the arm rest, for a reclining lounger employing a single folded over arm rest 660, a D-ring 662, and an S-shaped hook 664. As illustrated, the D-ring is secured within chamfered surfaces on the side supports 28, 30 in receiving the arm rest 660, whose underside section 666 is provided with a loop 668 to receive one end of an S-clip clasp 664. The other end of the S-clip 664 fits within one of several notches 669 in the arm rest 660—either pulling the arm rest 660 tighter (thereby shortening the arm rest) as in the position shown, or lengthening it as it is moved rearwardly to the left from aperture to aperture, consistent with increasing the lounger's recline. The reclining beach chair lounger with this adjustable arm length construction is shown in FIG. 56.)

4. Collapsible Foot Rest

In certain instances, a user might desire to employ with the reclining beach chair or lounger a foot rest along the lines of an ottoman. To accommodate such desire, the reclining beach chair of FIG. 1, or that of FIG. 47 could be modified still further simply through modification of the front pad connectors 40. More specifically—and as shown in FIG. 57—the front pad connectors 40 could be arranged to include a clip 690 to secure by rivet 691 or otherwise, one end 699 of a further tubular member 692 joined with a similar tubular member 693 along its length, as by a rivet 694. The extending end 695 of the two tubular members 692, 693 then fit within folds at the forward most end of the fabric seat liner 131 for the lounger. FIG. 58 illustrates this arrangement for a fabric liner 131 of a 1-piece construction. Where a 2-piece construction is employed for the liner (FIG. 59, upper section 131A, lower section 131B), the added section 131B can be secured about the upper bends 255 of the front legs 212, 214 by individual ties 696 (where arm rests are employed, or about the front connection 35 where they are excluded [as in FIG. 1]; or in the event a cap secures the seat liner upper section 131A to the front connector 35 [as in FIG. 5], only a tie 696 is needed to secure the lower section 131B to the connector 35). FIG. 60 illustrates a Y-type connector 697 between the arms of which the end 699 of the tubings 692, 693 are joined, with the Y connector 697 being fastened to the front pad connector 40 by a screw or other bolt connection 698 extending upwardly through the pad connector. With either the 1-piece construction of the liner, or with the 2-piece construction, the reclining beach chair or lounger can be fully collapsed when it is desired to stow or transport the lounger, with the clips 690 allowing the front extenders to rotate upwardly and downwardly in a vertical plane.

While there have been described what are considered to be preferred embodiments of the present invention, it will be appreciated by those skilled in the art that modifications can be made without departing from the scope of the teachings herein. Thus, whereas the arm rest and foot rest of the invention have been described in the context of the reclining beach chair or lounger of my Ser. No. 09/551,664, U.S. Pat. No. 6,179,374 invention, their teachings will apply equally as well for a reclining beach chair whose lower legs are not bent outwardly so as to rest closer to the ground. And, although the front extender tubular members 692 and 693 of the foot rest are held between the arms of a Y-type connector 697, a similar U-type connector could equally be employed, continuing to accept the screw or bolt 698 extending upwardly through the front pad 40, or otherwise extending downwardly through the connector into the pad 40 in yet a further modification. For at least such reason, therefore, resort should be had to the claims appended hereto for a true understanding of the scope of the invention.

I claim:

1. The combination comprising:

a casual seat of tubular members having a fabric liner forming a seat area and a back rest area when opened and collapsible front-to-back and side-to-side for storage with an empty slot defined by individual ones of said tubular members when closed;

a bag dimensioned for fitting vertically within said empty slot area;

a first fastener coupling one end of said bag to said liner along said seat area at a first position thereon;

a second fastener coupling a second end of said bag to said liner along said seat area at a second position thereon; and with at least one of said first and second fasteners being detachable from said liner.

2. The combination of claim 1 wherein both of said first and second fasteners are detachable from said fabric liner.

3. The combination of claim 1 wherein said first fastener secures to said fabric liner by a stitching thereto.

4. The combination of claim 3, including one part of a 2-part hook-and-loop adhesive on a rear surface of said bag, and a second part of said 2-part hook-and-loop adhesive at an underside of said seat area of said fabric liner.

5. The combination of claim 3, including a second detachable hook on said bag for coupling to said fabric liner along said back rest area of said liner.

6. The combination of claim 1 wherein said second fastener secures to said fabric liner by a detachable hook.

7. The combination of claim 1 wherein said firstfastener secures to said fabric liner by a stitching thereto, and wherein said second fastener secures to said fabric liner by a detachable hook.

8. The combination of claim 7, including one part of a 2-part hook-and-loop adhesive on a rear surface of said bag, and a second part of said 2-part hook-and-loop adhesive at an underside of said seat area of said fabric liner.

9. The combination comprising:

a casual seat of tubular members having a fabric liner forming a seat area and a back rest area when folded open, and to a collapsed condition for storage with an empty slot defined by individual ones of said tubular members when folded closed;

a bag dimensioned for fitting within said empty slot;

a first fastener coupling one end of said bag to said liner along said seat area at a first position thereon;

a second fastener coupling a second end of said bag to said liner along said seat area at a second position thereon; and with at 1eare one of said first andsecond fasteners being thereafter detachable from said liner to store said bag within said empty slot when said tubular members are folded closed;

wherein said first fastener secures to said fabric liner by a stitching thereto, and wherein said second fastener secures to said fabric liner by a detachable hook;

further including a second detachable hook on said bag for coupling to said fabric liner along said back rest area of said liner;

wherein said bag also includes a cup holder; and also including a bumper on a rear surface of said bag extending outwardly therefrom and against individual tubular members of said casual seat when opened for use.

* * * * *